US006271740B1

(12) United States Patent
Chikamatsu

(10) Patent No.: US 6,271,740 B1
(45) Date of Patent: Aug. 7, 2001

(54) REED RELAY

(75) Inventor: Kiyoshi Chikamatsu, Kanagawa (JP)

(73) Assignee: Agilent Technologies, Inc., Loveland, CO (US)

( * ) Notice: Subject to any disclaimer, the term of this patent is extended or adjusted under 35 U.S.C. 154(b) by 0 days.

(21) Appl. No.: 09/605,669

(22) Filed: Jun. 28, 2000

(30) Foreign Application Priority Data

Jun. 29, 1999 (JP) ..... 11-183972

(51) Int. Cl.[7] ..... H01H 51/27; H01H 1/66
(52) U.S. Cl. ..... 335/151; 335/299
(58) Field of Search ..... 335/151–154, 335/205–208, 299

(56) References Cited

U.S. PATENT DOCUMENTS

| | | | | |
|---|---|---|---|---|
| 3,993,970 | * | 11/1976 | Brownell | 335/5 |
| 4,752,754 | * | 6/1988 | Strauss | 335/151 |
| 5,252,936 | | 10/1993 | Norimatsu | 335/151 |
| 5,742,216 | | 4/1998 | Iwasaki et al. | 335/151 |

FOREIGN PATENT DOCUMENTS 2-68829 3/1990 (JP) .

OTHER PUBLICATIONS

*"Static Electricity Between Surfaces and Polymers"*, Yuji Murata, pp. 34–36, 1998.
*"Modeling of Thermally Stimulated Currents in Polytetrafluoroethylene"*, Remke, et al., J. Appl. Pys., 54(9), pp. 5262–5266, Sept., 1983.

* cited by examiner

*Primary Examiner*—Ramon M. Barrera

(57) ABSTRACT

A reed relay with which offset current is prevented competently, even when a coil is excited for relay operation, and high-speed, high-accuracy measurement of very low signals is possible, and energy consumption and production costs during assembly are low. The reed relay comprises a reed switch, an electrostatic shielded pipe through which the reed switch passes, an insulating support members and that support the reed switch inside the electrostatic shielded pipe, a coil bobbin that has a tube for insertion of electrostatic shielded pipe, and a coil wound and installed around the bobbin.

18 Claims, 23 Drawing Sheets

REED RELAY

The present invention pertains to a relay with which a reed switch inserted into an electrostatic shielded pipe is opened and closed by a magnetic coil and a system for measuring very small current on the order of femtoamperes (fA). In particular, it pertains to a relay that is used to control transmission of Joule effect heat of the magnetic coil to the highly insulated holding member that holds the electrostatic shielded pipe and reed switch in order to inhibit the generation of thermally stimulated current (offset current) at this holding member and thereby avoid disturbance of the signal on the signal conductors, or the signal lines, of the relay.

BACKGROUND OF THE INVENTION

FIG. 1 shows the structure of conventional reed relay 100. Signal conductor terminals, or signal line terminals, 117*a* and 117*b* at both ends of reed switch 101 are held near both ends of electrostatic shielded pipe 103 by insulators 102*a* and 102*b*, which are plates called bushings and have holes in the center through which the terminals pass. This electrostatic shielded pipe 103 is inserted into the cylindrical hollow part of coil bobbin 104. Coil 105 for excitation is wound and installed in the concave part around the outside of coil bobbin 104. This concave part is further packed with resin 106 and this is covered by magnetic shield case 107. Here, electrostatic shielded pipe 103 and coil bobbin 104 are adjacent and contact one another. Moreover, when reed relay 100 is used in the circuit, it is preferred that electrostatic shielded pipe 103 is connected to guard wires that and function as an active guard or passive guard. Please note that unless otherwise specified, the same symbols are used to describe the same structural elements in the figures of the present Specification.

Nevertheless, reed relay 100 poses many problems when used for the measurement of very small currents on the order of fA in terms of the relationship between the latency time or wait time until the measurement values stabilize and offset current reduces, as described below:

FIG. 2 shows the measurement results of the offset current of reed relay 100. The x-axis shows the time that has passed when 0 seconds serves as the time when excitation current begins to flow to the coil, and the y-axis shows the current flowing through the signal conductors of the relay as detected by an ammeter for very low currents with a guard feature. In this case, the guard terminals of the ammeter are wired so that they are connected to the electrostatic shielded pipe of the relay, with the voltage of the signal conductors being constant at 0V, and a 10 mA rated current flows as excitation current to the coil. Please note the fact that the reed switch is turned on with excitation of the coil in this case. According to FIG. 2, excitation current begins to flow to the coil and the negative polarity current gradually increases in approximately 80 seconds to peak at −6 fA. Thereafter the negative polarity current settles down with convergence to approximately 0 fA approximately 300 seconds after starting excitation and stabilization to the steady state.

Thus, conventional reed relays are inappropriate for high-speed and high-precision measurement of very small currents, because an offset current of approximately several fA flows for approximately 100 seconds beginning immediately after the relay has been turned on.

Leakage current or thermo-electromotive force due to a contact potential difference between different types of metals, as described in Japanese Patent Laid-open (Kokai) No. Hei 2(1990)-68,829, and dielectric absorption in an insulator, as described in Japanese Patent Laid-open No. Hei 8(1996)-279,314 were considered to be factors of the above-mentioned offset current in the past, but of course unclear points remain. That is, the explanation of leakage current being transmitted over the surface of an insulator or of current being generated by potential difference between relay terminals due to thermo-electromotive force, which is caused by the difference in the amount of heat conduction towards the both ends of relay terminals, applies only to the steady state current and contradicts the phenomenon of offset current naturally converging at 0 fA. Moreover, the voltage of the signal conductors was constant at 0 V in the measurements shown in FIG. 2, and therefore, it does not appear that a potential difference with which dielectric absorption would occur was produced between the signal conductors and the electrostatic shielded pipe.

In any case, in the past very low currents on the order of fA were observed after waiting for approximately 100 seconds until the offset current stabilized, and therefore, high-speed measurement of the very low current was not possible. Very low currents could also be measured by reducing wait time, recognizing that the results would be inaccurate. Nevertheless, the measurement devices have become faster each year and therefore, it is necessary to develop a high-performance reed relay for very low currents with which the wait time can be curtailed and speed can be increased.

The present inventor hypothesized the following based on the fact that the above-mentioned offset current is due to thermally stimulated current that is produced when Joule effect heat generated by the coil propagates or transmits to the contact surface between the metal and the insulator:

That is, by means of the reed relay in FIG. 1, heat that has been generated by the coil is transmitted as shown below.

One is coil (105)→coil bobbin (104)→electrostatic shielded pipe (103)→bushing (102*a*, 102*b*), and the other is coil (105)→resin (106)→magnetic shield case (107)→air.

Plastics and resin materials with high insulating performance generally have thermal conductivity that is two to three orders of magnitude lower than metals, and therefore, heat is conducted via the above-mentioned two routes on the order of materials with good→poor→good→poor conductivity. As a result, thermal resistance becomes several 10 K/W and, for instance, when as much as 0.1 W heat is generated by the coil, the temperature of the electrostatic shielded pipe will probably also rise by several K.

The electrons trapped at the surface on the electrostatic shielded pipe 103 side of bushings 102*a* and 102*b* are excited by thermal energy with this rise in temperature and are released to inside electrostatic shielded pipe 103. In this case, electrons are probably fed from the sides of signal conductor terminals 117*a* and 117*b* to bushings 102*a* and 102*b*, which are insulators, in a form that maintains electric neutrality.

The fact that this hypothesis is correct was demonstrated as follows by experiments. First, as shown in FIG. 3, heat-absorbing element 311, which is called a Peltier device, is fastened directly above coil bobbin 104 of the relay. Coil 105 is not excited. The voltage of the signal conductors is constant at 0 V and only Peltier device 311 is operated. That is, heat passes through coil 105 and is transmitted in the opposite direction from the case for the measurements in above-mentioned FIG. 2 in the sequence such as:

Peltier element (311)←magnetic shield case (107)←resin (106)←coil (105)←coil bobbin (104)←electrostatic shielded pipe (103)←bushings (102*a*, 102*b*), and heat is absorbed or cooling takes place.

The offset current waveform in this case is the waveform shown in FIG. 4A. The inventors discovered that in this case, the polarity of the offset current is positive and opposite from FIG. 2.

FIG. 4B shows the results of further flowing a rated current of 10 mA to coil 105 and performing the same operation as with Peltier device 311 under the above-mentioned conditions based on the above-mentioned discovery. It is clear that the current of negative polarity in FIG. 2 and the current of positive polarity in FIG. 4A cancel each other out so that the offset current is controlled.

Based on the above-mentioned results, the mechanism of the above-mentioned offset current appears to be as follows:

The heat generated from the coil is transmitted to the electrostatic shielded pipe via the coil bobbin and reaches the bushings. Electrons are trapped at the surface energy level (Fermi level) on the bushing side of the surface of contact between the bushings, which are insulators, and the electrostatic shield. These electrons are excited when exposed to thermal energy and jump over the energy barrier and are released into the metal as free electrons (for instance, refer to FIG. 6.9 on page 36 of Y. Murata, "Static electricity between surfaces and polymers," 1988, Kyoritsu Shuppan). Electrons are newly fed from the signal conductor side in order to maintain the electric neutrality of the bushing after electrons have flown out at the surface level on the signal conductor side, which is the side opposite to the shielded pipes, in this case. This apparently becomes the negative polarity current on the order of femtoamperes (that is, thermally stimulated current) that is observed.

The mechanism by which thermally stimulated current is generated in high-insulating materials consisting of fluorinated polymer resin, such as PTFE (polytetrafluoroethylene) and FEP (fluorinated ethylene propylene copolymer), etc., is described in detail in R. L. Remke, H. Von Seggem, "Modeling of thermally stimulated currents in polytetrafluoroethylene (PTFE)," J. Appl. Phys. 54(9), pp 5262 to 5266, September, 1983.

In contrast to the above-mentioned, electrons in the electrostatic shielded pipe near the bushings lose their energy and can be trapped on the trap level inside the bushings during the process whereby the Peltier device operates to take thermal energy from the bushing. Electrons at the surface on the side of the signal conductor terminal of the bushing are released to the signal conductor to maintain electrical neutrality and a positive polarity current is observed.

Thus, it can be theoretically supported that offset current is generated due to the Joule heat effect of the coil.

When conventional technology for reed relays is re-examined based on the results of the above-mentioned discussion, it is clear that conventional reed relays are not an effective countermeasure for handling thermally stimulated currents.

For instance, by means of the technology disclosed in Utility Model Laid-open No. Hei 5(1993)-31,078, the coil bobbin and electrostatic shield come into contact over their entire surface and the same mechanism as discussed in FIG. 1 can be used. Thus, an insulator is packed in the electrostatic shielded pipe up to the reed switch. Therefore, the structure is one with which a thermally stimulated current can easily flow.

By means of a different technology, a structure is used wherein the reed relay 100 in FIG. 1 has a large hollow cylinder of coil bobbin 104 into which electrostatic shielded pipe 103 will be inserted, and when coil bobbin 104 and electrostatic shielded pipe 103 are soldered to the circuit board, they are soldered so that they are supported by the lead wires of coil 105 (not illustrated) and the signal conductor terminals 117*a* and 117*b* of the reed switch at a position where the two will not make direct contact. It appears that as a result, there is only air between the coil bobbin and the electrostatic shielded pipe and therefore, heat will very rarely be transmitted. Nevertheless, when assembled, first the coil bobbin is soldered to the board, then the electrostatic shielded pipe is inserted, and both signal terminals of the reed switch are processed by cutting and bending to adjust the position to the two ends of the electrostatic shielded pipe. Finally, it is necessary to carefully solder the electrostatic shielded pipe to the board so that there is a specific distance maintained from the inside walls of the hollow part of the coil bobbin. Thus, assembly is difficult and production cost is too high by this technology.

Yet another technology is disclosed in Japanese Patent Laid-open No. Hei 2(1990)-68,829 that was previously presented. By means of the technology disclosed in this patent, two excitation coils are set up. The both of coils are always excited regardless whether the relay turns on or off so that the total amount of heat generated by the coils is kept constant. Opening and closing of the contacts is performed by changing the combination of the directions of the current flowing to the coils. By means of this technology, the temperature of the relay is constant and therefore, changes in thermo-electromotive force due to changes in the temperature of the reed switch can be minimized. Moreover, it appears that this technology is also effective in suppressing thermally stimulated current. However, excitation currents must always be flowing to the coils by this method, and therefore, as the number of relays is increased, the power consumption is also increased. A large-capacity power source and large cooling facility become necessary, which is not economical. Moreover, this technology is inconvenient because very low currents cannot be measured during the 100 seconds when coil excitation begins and the steady state is reached.

As previously explained, these problems that were first made clear through the discussions of the inventor are attributed to (1) the fact that the structure is one with which the heat generated by the coil is readily transmitted to the electrostatic shielded pipe, and (2) further, the structure is one with which the heat generated by the coil is readily transmitted from the electrostatic shield to insulators that hold the signal conductors of the reed switch.

Consequently, the object of the present invention is to solve the above-mentioned problems and present a reed relay with which offset current is controlled or suppressed competently, even if the coil is excited for relay operation, high-speed and high-accuracy measurement of very low signals is possible, and further, power consumption is low and production costs during assembly are low.

SUMMARY OF THE INVENTION

The inventors completed the present invention upon discovering that focusing on above-mentioned points (1) and (2), the above-mentioned problems can be solved by the actual solutions of: (A) reducing the net cross-sectional area on the thermal conduction path from the coil bobbin to the electrostatic shielded pipe, (B) placing a means for absorbing heat in the coil bobbin in order to absorb the heat generated by the coil before it is transmitted to the electrostatic shielded pipe, (C) placing in the electrostatic shielded pipe itself a means that prevents heat generated by the coil from being transmitted to insulatior that holds the signal conductor terminals, or (D) placing a means for absorbing heat in the electrostatic shielded pipe in order to absorb the heat from the coil before it is transmitted to the insulatior that holds the signal conductor terminals.

By means of an embodiment of the present invention according to above-mentioned concrete solution (A), the reed relay comprises a reed switch, an electrostatic shielded pipe through which the reed switch passes, insulating support members that support the reed switch inside the electrostatic shielded pipe, a coil bobbin with a hollow part in which the electrostatic shielded pipe is placed, and a coil that is wound and installed around the coil bobbin. There is a thermal conduction-blocking means that makes it difficult for heat from the coil to be transmitted between the coil bobbin and the electrostatic shield and said blocking means also serves as a mechanical support for the coil bobbin and the electrostatic shielded pipe.

The thermal conduction-blocking means here is characterized in that it comprises a member that is narrower than the body of the coil bobbin in order to reduce the net cross-sectional area (or effective cross-sectional area) of the thermal conduction path. For instance, it can have one or multiple ring-shaped or annular members, or it can have multiple columnar members.

By means of this structure, heat generated by the coil is transmitted to the coil bobbin, but the thermal-conduction blocking means all but completely prevents the heat from being transmitted to the electrostatic shielded pipe and therefore, there are almost no changes in the temperature of insulating support member. As a result, thermally stimulated current is kept from flowing to the reed switch.

By means of an embodiment of the present invention according to concrete solution (B), the reed relay comprises a reed switch, an electrostatic shielded pipe through which the reed switch passes, insulating support members that support the reed switch inside the electrostatic shielded pipe, a coil bobbin with a hollow part in which the electrostatic shielded pipe is placed, a coil that is wound and installed around the coil bobbin, and a coil bobbin heat-absorbing means attached to the coil bobbin, in order to reduce the heat from the coil before said heat is transmitted to the electrostatic shielded pipe.

The first heat-absorbing means here can be a heat sink or a Peltier device.

By means of this structure, the heat that has been generated by the coil is mainly absorbed by the heat-absorbing means of the coil bobbin rather than being transmitted from the coil bobbin to the electrostatic shielded pipe, and therefore, changes in temperature of the insulating support members can be prevented and thermally stimulated current can be kept from flowing to the reed switch.

By means of an embodiment of the present invention according to concrete solution (C), the reed relay comprises a coil bobbin with a hollow part, a first electrostatic shielded pipe placed in the hollow part, ring-shaped electroconductive thermal conduction-blocking means attached to both ends of the first electrostatic shielded pipe, a second and a third shielded pipe further attached to the outside of the electroconductive thermal conduction-blocking means, a reed switch that passes through the first through third electrostatic shielded pipes, insulating support members that support the reed switch and are placed inside the second and third electrostatic shielded pipes, and a coil that is wound and installed around the coil bobbin.

The electroconductive thermal conduction-blocking means here can be a ring, the surface of which is covered with an electroconductive film to retain electroconductivity and the inside of which is made from an insulating material.

By means of this structure, the heat generated by the coil is transmitted through the coil bobbin to reach the first electrostatic shielded pipe, but transmission of this heat is prevented by the electroconductive thermal conduction-blocking means. Therefore, changes in the temperature of the insulating support members inside the second or third electrostatic shielded pipe can be prevented and as a result, thermally stimulated current is kept from flowing to the reed switch. Furthermore, the electroconductive thermal conduction-blocking means is electroconductive and therefore, overall shielding performance over three electrostatic shielded pipes is not degraded.

By means of an embodiment of the present invention according to concrete solution (D), the reed relay comprises a reed switch, an electrostatic shielded pipe through which the reed switch passes, an insulating support member that supports the reed switch inside the electrostatic shielded pipe, a coil bobbin in which the electrostatic shielded pipe is placed, a coil that is wound and installed around the coil bobbin, and a shielded-pipe heat-absorbing means that is attached to the above-mentioned electrostatic shielded pipe in order to reduce the heat that has been transmitted to the electrostatic shielded pipe before this heat is transmitted to the above-mentioned reed switch.

By means of this structure, the heat generated by the coil is transmitted through the coil bobbin and reaches the electrostatic shielded pipe, but the heat is absorbed by the shielded-pipe heat-absorbing means before it reaches the insulating support member. Therefore, changes in the temperature of the insulating support member can be prevented, and as a result, thermally stimulated current can be kept from flowing to the reed switch.

Moreover, by means of an embodiment of the present invention common to above-mentioned concrete solutions (A) through (D), the reed relay comprises a coil bobbin, an electrostatic shielded pipe that is inserted in this coil bobbin, insulating support members inside this electrostatic shielded pipe inserted in the coil bobbin, a reed switch that is held inside the electrostatic shielded pipe by the above-mentioned support members, and a thermal conduction-blocking means between the coil that is wound and installed around the coil bobbin and the relay switch in order to keep thermally stimulated current from flowing to the above-mentioned reed switch.

Furthermore, it goes without saying that a reed relay with superior effects can be made by using any combination of embodiments based on above-mentioned concrete solutions (A) through (D).

DETAILED DESCRIPTION OF THE PREFERRED EMBODIMENTS

Figure 5:
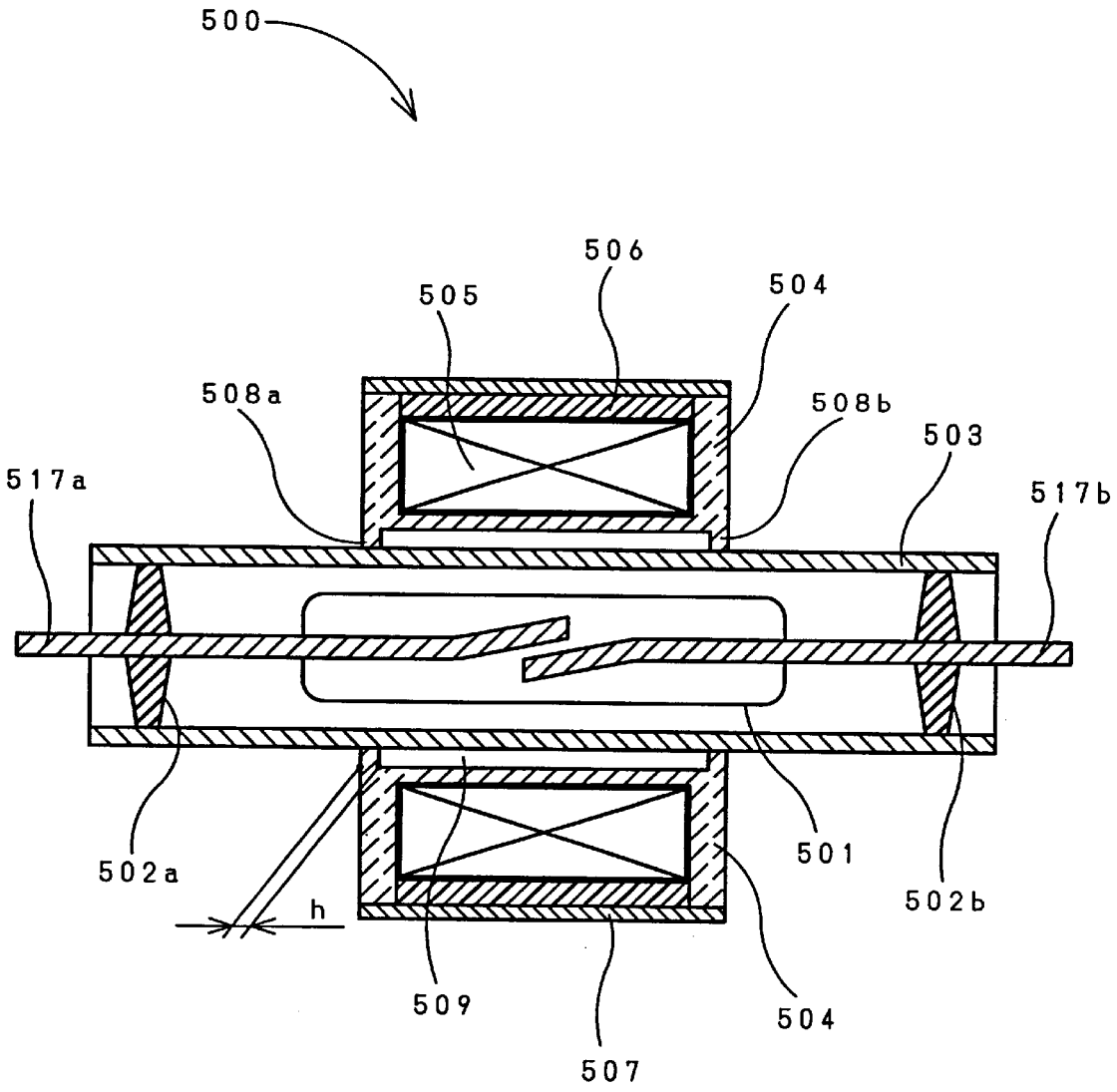
FIG. 5 is a cross section showing the first embodiment of the present invention.

FIG. 5 is a structural cross section of the first embodiment of the present invention.

Reed switch 501 is a switch of contacts sealed in a glass tube, etc. This switch is held inside electrostatic shielded pipe 503 by bushings 502*a* and 502*b* made from a high-insulating material. Electrostatic shielded pipe 503 is placed inside the hollow cylinder of coil bobbin 504, with overhangs 508*a* and 508*b* placed at the open ends of this hollow part. Coil bobbin 504 and electrostatic shielded pipe 503 make contact at these overhangs 508*a* and 508*b* only so that there is space 509 between the inside face of the hollow part of the coil bobbin and the electrostatic shielded pipe.

Furthermore, in FIG. 5, overhangs 508*a* and 508*b* are placed at both ends of the hollow part of coil bobbin 504, but they can also be placed inside this hollow part. Moreover, three or more overhangs can be employed. In addition, a substitute embodiment can have a structure where multiple overhangs are joined in a spiral.

Figure 17A:
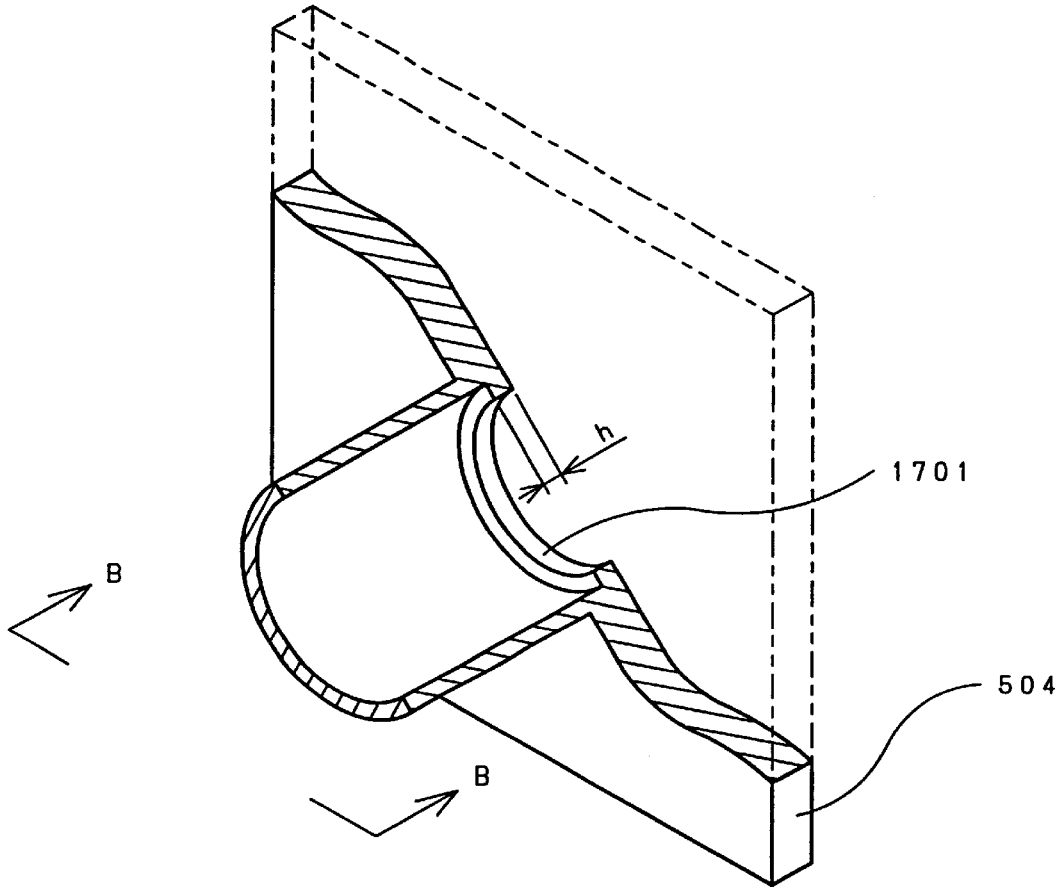
FIG. 17A is a diagram showing the shape of the overhangs of the coil bobbin of the first embodiment of the present invention.
Figure 17B:
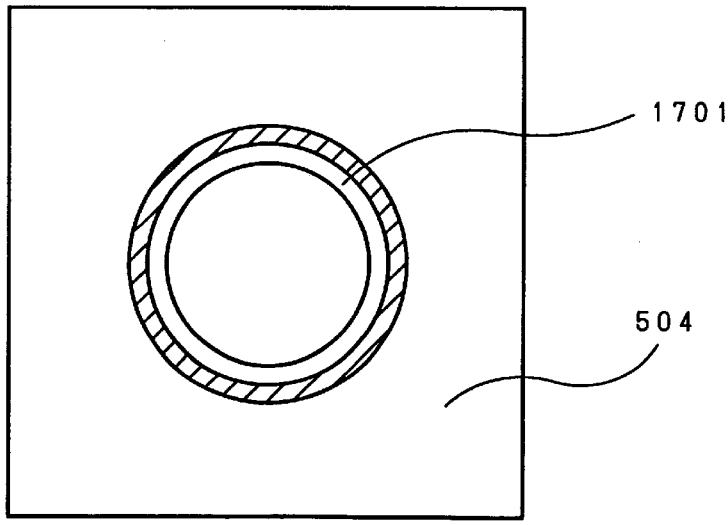
FIG. 17B is a diagram of the coil bobbin shown in FIG. 17A as seen from the B—B cross section.
Figure 18A:
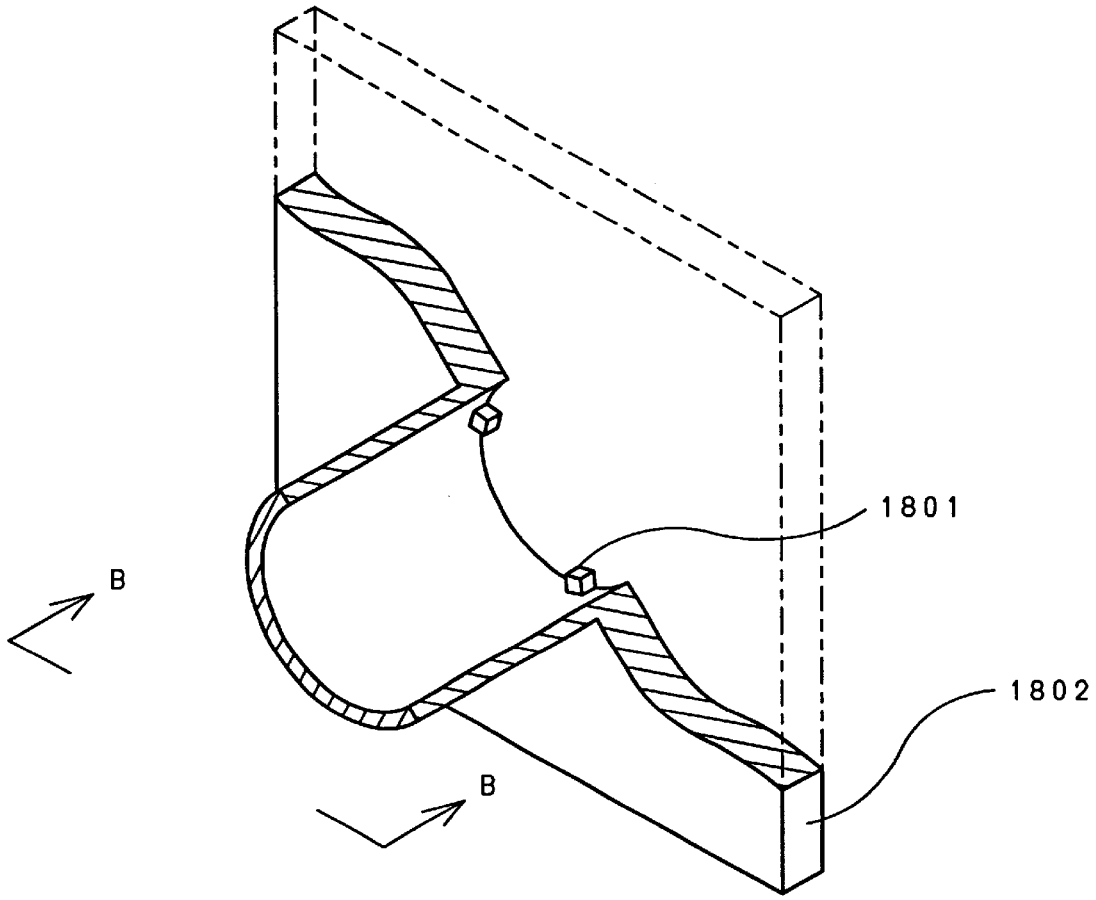
FIG. 18A is a diagram of an alternative to the shape of the overhang in FIG. 17 of the present invention.
Figure 18B:
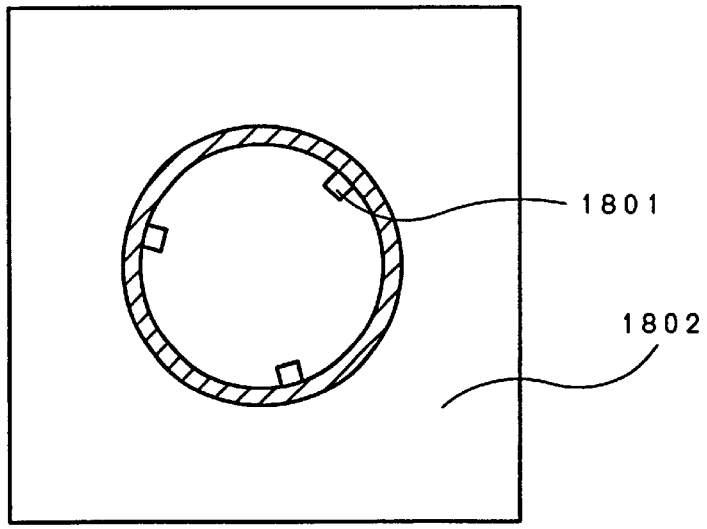
FIG. 18B is a diagram of the coil bobbin shown in FIG. 18A as seen from the B—B cross section.
Figure 19A:
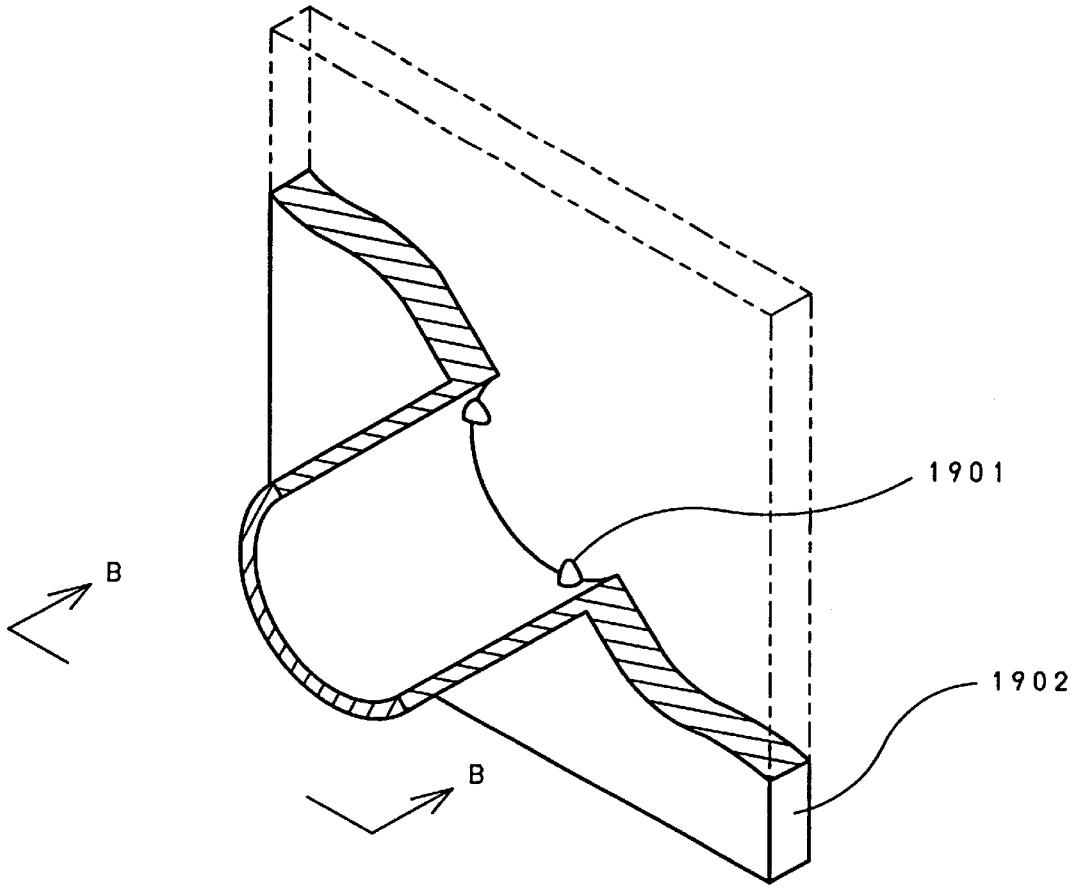
FIG. 19A is a diagram of an alternative to the shape of the overhang in FIG. 18 of the present invention.
Figure 19B:
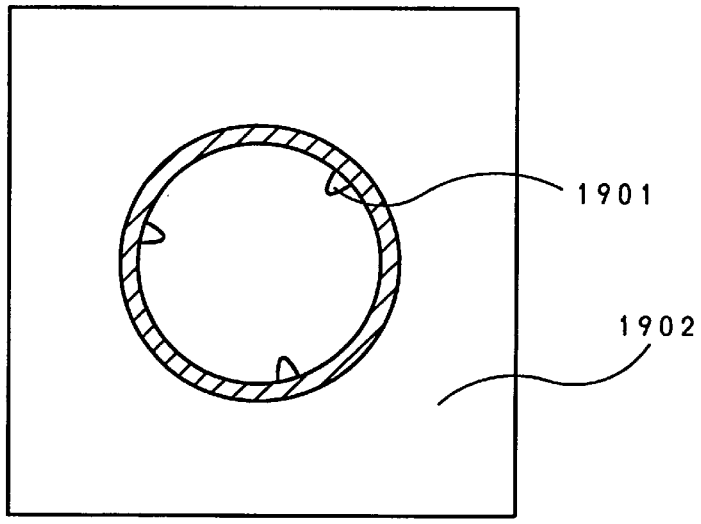
FIG. 19B is a diagram of the coil bobbin shown in FIG. 19A as seen from the B—B cross section.
Figure 20A:
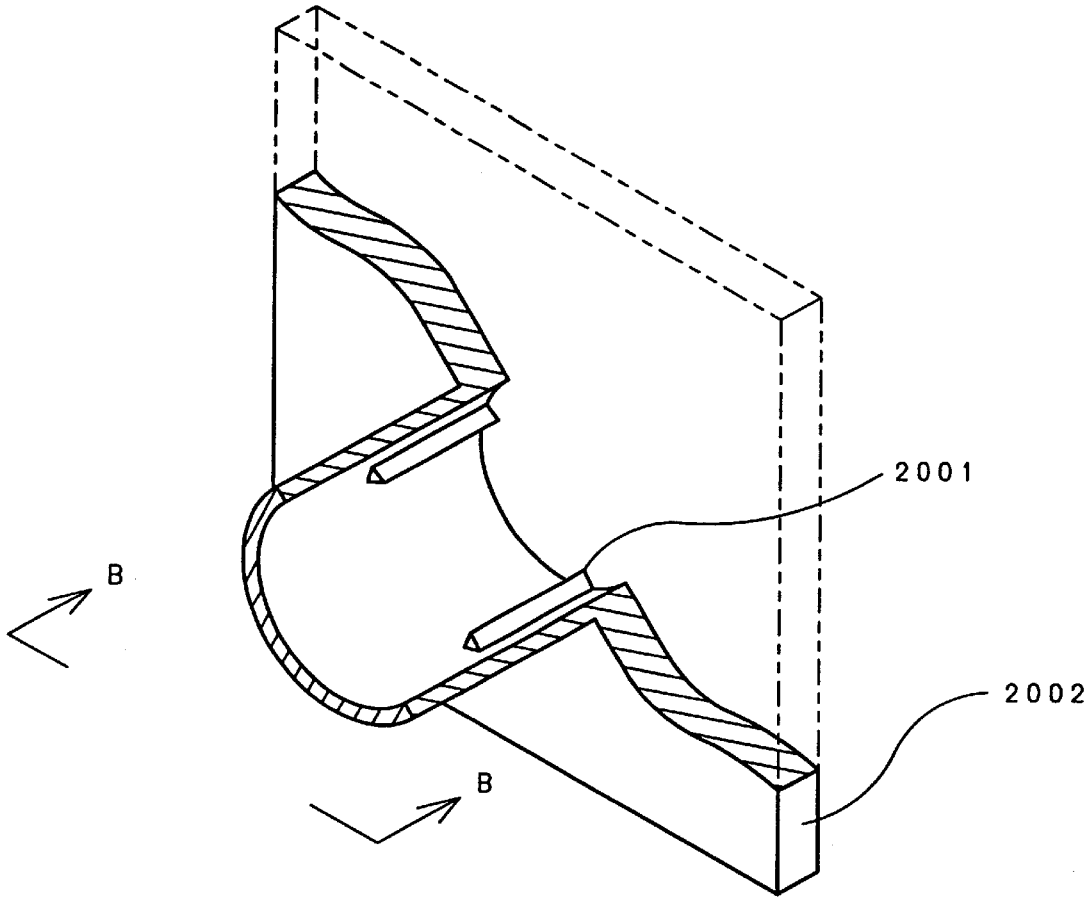
FIG. 20A is a diagram of an alternative to the shape of the overhang in FIG. 17 of the present invention.
Figure 20B:
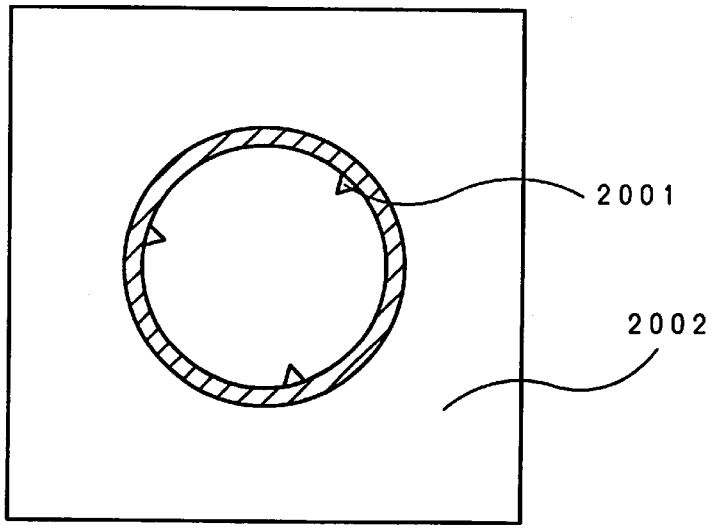
FIG. 20B is a diagram of the coil bobbin in FIG. 20A as seen from the B—B cross section.

The shape of the overhangs will be explained in further detail using FIGS. 17A through 20B. FIGS. 17B, 18B, 19B and 20B here show the coil bobbins in FIGS. 17A, 18A, 19A and 20A, respectively, as seen from the B—B cross section. As shown in FIGS. 17A and 17B, overhangs 508*a* and 508*b* of coil bobbin 504 shown in FIG. 5 are annular members 1701 with a certain thickness h in the lengthwise direction of the cylindrical hollow part. These annular members are joined in the direction of the inner periphery of the hollow part. As previously mentioned, there can be multiple annular members at any place in the lengthwise direction on the inside of the hollow part of coil bobbin 504. The annular member can also be a semi-annular member that has a small discontinuous part in the direction of the inner periphery. Furthermore, the number of discontinuous parts in the direction of the inner periphery can be increased and multiple semi-annular members can be scattered around the inner periphery. In addition, it is also possible to make the width of the semi-annular member narrower in the direction of the inner periphery and to place multiple columnar structures 1801 on the inner periphery of the hollow part, as shown by coil bobbin 1802 in FIGS. 18A and 18B. Columnar structure 1801 in FIG. 18A can be scattered, for instance, randomly placed, over the entire inside face or only part of the inside face of the hollow part of the coil bobbin to support the electrostatic shielded pipe. Furthermore, the columnar structures can also be nodular with tapered ends, as shown by coil bobbin 1902 in FIGS. 19A and 19B. Moreover, tapered structure 2001 wherein the depth of the columnar structure in FIG. 19A in the direction of length of the hollow part is longer than the width in the direction of the inner periphery, as shown by coil bobbin 2002 in FIGS. 20A and 20B, can also be employed. The overhangs in any of these embodiments should have a structure that will mechanically support the electrostatic shielded pipe while reducing the net cross-sectional area of the thermal conduction path from the coil to the electrostatic shielded pipe and thereby prevent thermal conduction. Various modifications to the overhangs are possible, and these are included in the present invention.

Returning to the description based on FIG. 5, once coil 505 has been wound and installed around the back face of coil bobbin 504, resin 506 is packed inside and magnetic shield case 507 is placed so that it covers coil 505.

An example of reed switch 501 is a high-insulating reed switch with an insulation resistance of $10^{14}$ Ω(100 teraohms) or more, in order to be used for circuit connection switchover in ammeters for measuring very low currents.

Moreover, the so-called ampere-turn value, which is the product of the number of turns of the coil and the excitation current in the present embodiment, is selected so that enough magnetic field to drive reed switch 501 is generated. This value is, for instance, 4,000 turns and a current of 10 mA. The winding resistance in this case is usually 1 kΩ. The amount of heat generated by the entire coil 505 in this case is 0.1 W.

Next, the materials that comprise the relay will be discussed. In order to make the winding of coil 505 a low power-consuming winding, a low-resistance copper material is usually used for the core wire. A wire coated with an insulating plastic, such as polyurethane, etc., is used. A plastic material such as polyacetal, etc., that is moldable and has high insulating performance and low thermal conductivity is selected for coil bobbin 504. Epoxy is used for the packing resin of coil bobbin 504.

In addition, a material that is corrosion resistant and has high thermal conductivity, such as brass, etc., is used for electrostatic shielded pipe 503. Magnetic shield case 507 made from a magnetic substance such as iron, etc., is used to prevent leakage of magnetic field from coil 505 and to prevent malfunctioning of the relay due to penetration by an outside magnetic field. Fluorinated high-insulating polymer (for instance, PTFE), is used for bushings 502*a* and 502*b*, which hold reed switch 501.

The structures characterizing the present invention will now be explained. There is an overhang on the surface of the side of coil bobbin 504, around which coil 505 is wound and installed, which touches electrostatic shielded pipe 503. The fact that the contact surface area between coil bobbin 504 and electrostatic shielded pipe 503 is reduced, with space 509 that is formed acting as a heat-insulating material to realize exactly the effect of a "vacuum bottle" and provide good thermal insulation between the coil bobbin and electrostatic shielded pipe, will be explained based on quantitative data.

Figure 6:
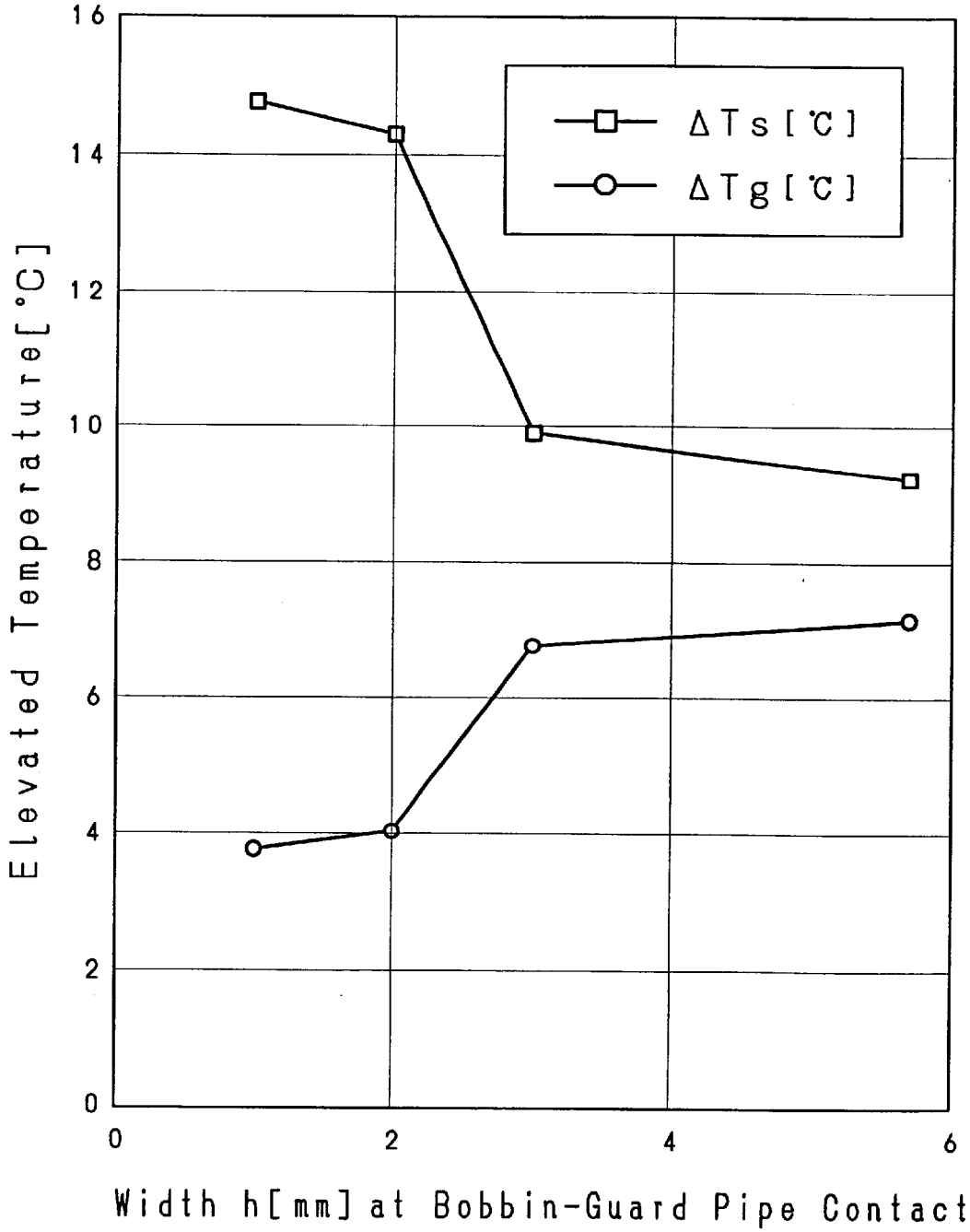
FIG. 6 is a graph showing the effect of preventing an increase in temperature in the structure of the first embodiment.

First, in order to compare a structure without overhangs and a structure with overhangs, the pattern whereby heat is transmitted from the coil was confirmed by thermal conduction simulation using the finite element method with width h of the overhang serving as a parameter (FIG. 6). The values in the following Table 1 were used for thermal conductivity of each structural member in this simulation.

TABLE 1

| Structural part | Thermal conductivity (W/m/K) |
|---|---|
| Core wire | 0.12–0.18 |
| Coil bobbin | 0.23 |
| Packing resin of coil bobbin | 0.3 |
| Electrostatic shielded pipe | 121.0 |
| Magnetic shield case | 80.0 |
| Bushing | 0.24 |

ΔTg in FIG. 6 shows the increase from the initial temperature at the interface between the bushings (502*a*, 502*b*) and the electrostatic shielded pipe (503) before power is applied to the coil, and ΔTs shows the increase in temperature from thermal equilibrium at the center of magnetic shield case (507).

The y-axis is the temperature that has risen and the x-axis is the width h of the overhangs (508*a*, 508*b*) of the coil bobbin in FIG. 5.

It is clear from FIG. 6 that ΔTg is dramatically inhibited, while ΔTs rises at an overhang width h of 2 mm or less. In short, thermal conduction to electrostatic shielded pipe 503 is reduced, while thermal conduction to magnetic shield case 507 is increased by the same amount, by overhangs 508*a* and 508*b*.

The increase in temperature of the electrostatic shielded pipe is 3.9 K when overhang width h=1 mm. When compared to the conventional 7.2 K when there is no overhang, it is clear that thermal conduction to the electrostatic shielded pipe is kept to half as much when overhangs are used.

Figure 1:
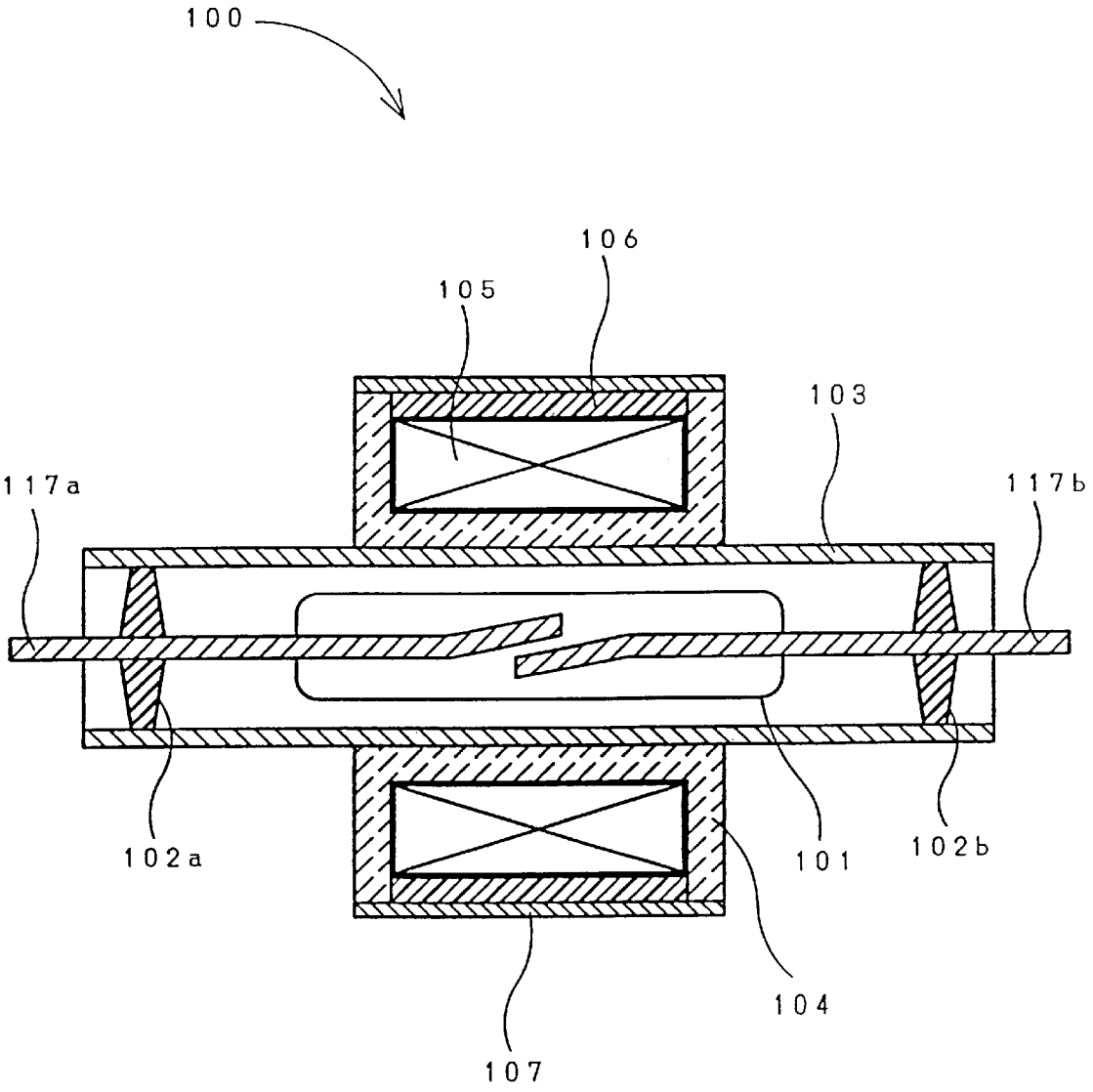
Fig. 1 (PRIOR ART)
FIG. 1 is a structural cross section of a conventional reed relay.
Figure 2:
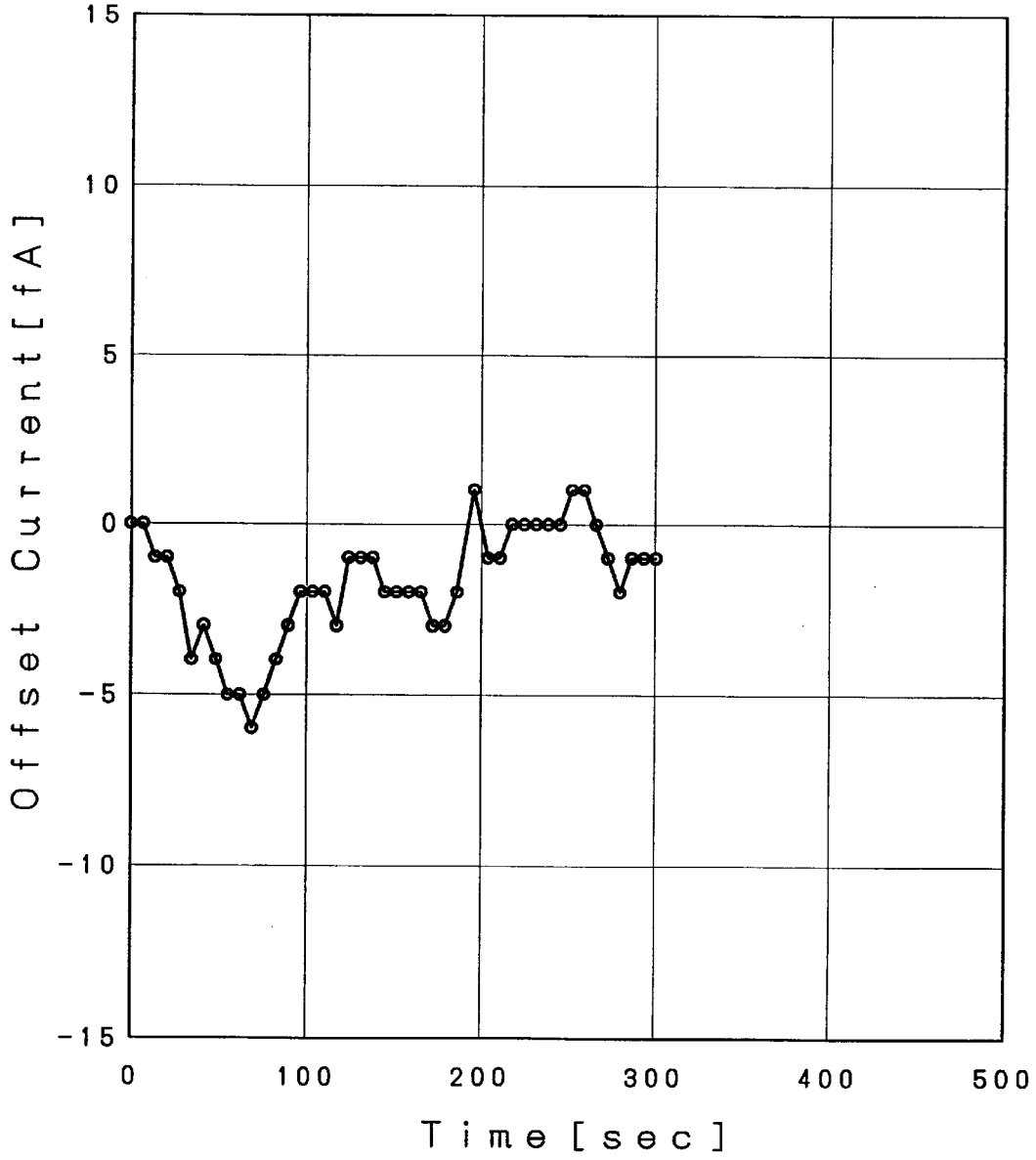
FIG. 2 is a graph showing the results of measuring offset current from the reed relay of FIG. 1.
Figure 3:
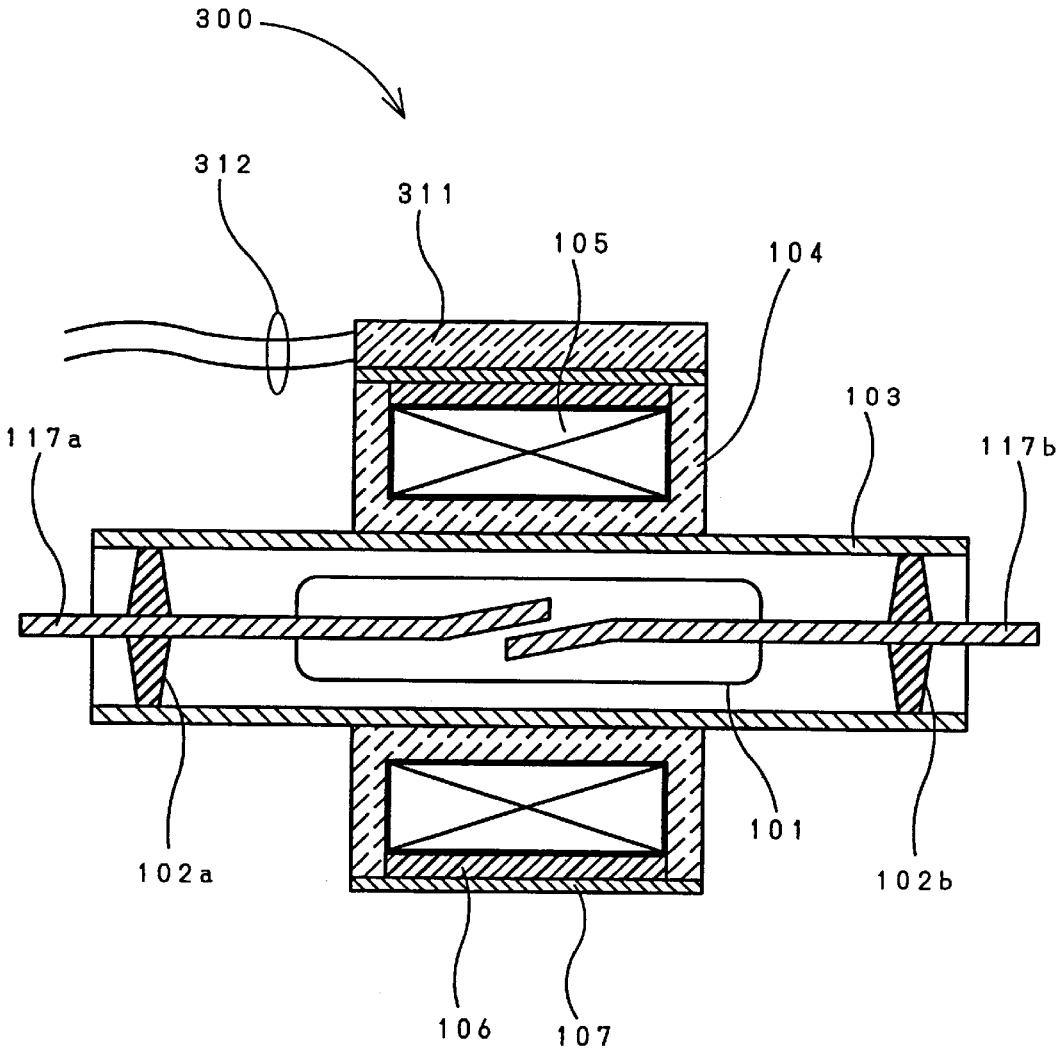
FIG. 3 is a structural cross section of the reed relay used in experiments to clarify the factors in offset current generation.
Figure 7:
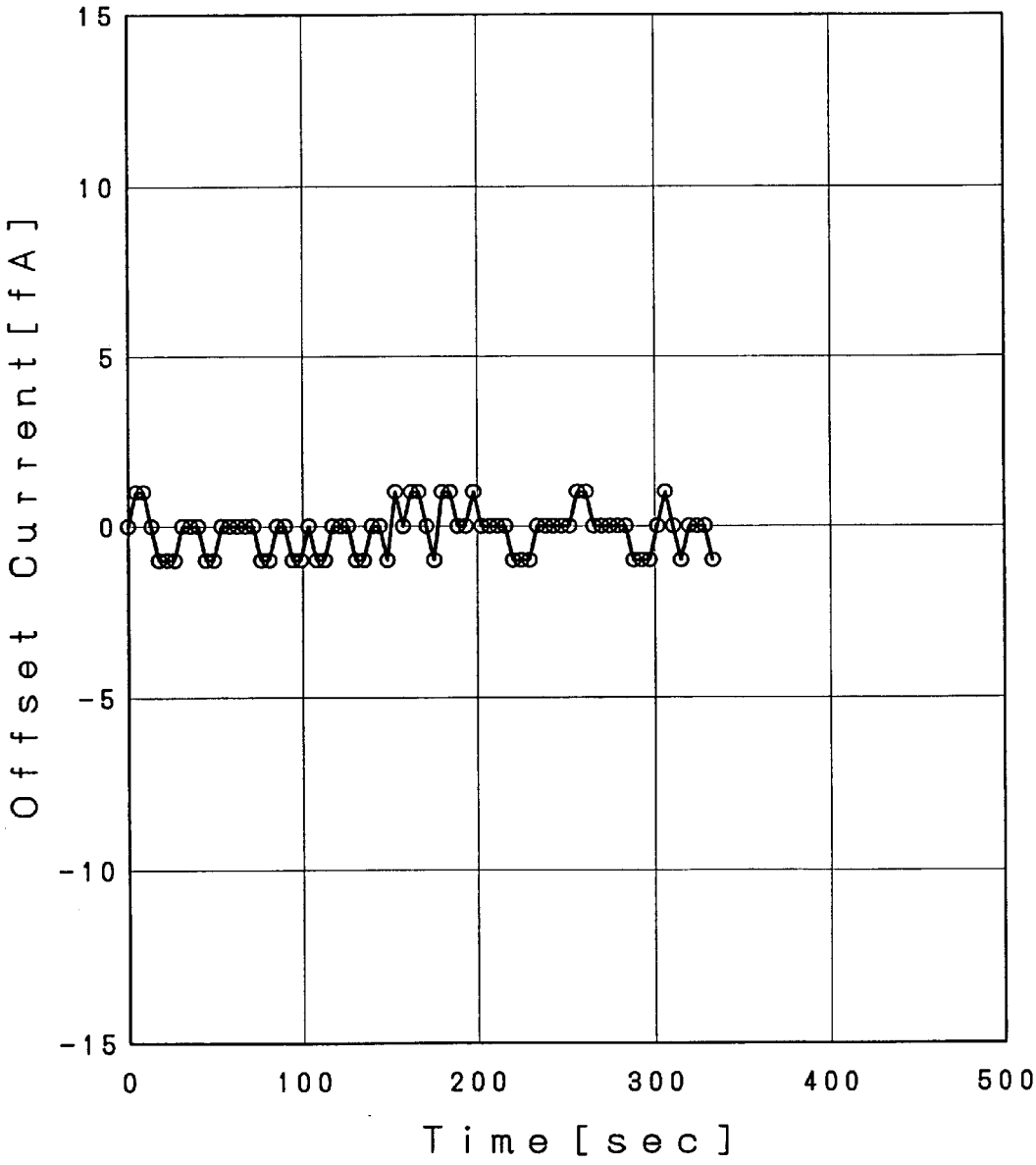
FIG. 7 is a graph showing the offset current waveform in the structure of the first embodiment.

Based on the above-mentioned, the generation of offset current by heat can be markedly controlled by selecting the appropriate width for overhangs 508*a* and 508*b*. FIG. 7 shows a graph of offset current as determined under the same conditions as the waveform in FIG. 2 using 0.4 mm for the overhang width of the relay shown in FIG. 5. In FIG. 2, offset current is flowing up to −6 fA during the approximately 80 seconds after excitation of the coil started and offset current had not stabilized to approximately 0 fA when 300 seconds after excitation of the coil started had not passed, but in FIG. 7 the measurements beginning immediately after excitation of the coil was started were within ±1 fA, indicating that offset current was sufficiently inhibited. Furthermore, the outer dimensions of the first embodiment are, for instance: electrostatic shielded pipe 503: length of 32 mm and outer diameter of 4.1 mm; coil bobbin: length of 16.1 mm, and overhang height of 0.25 mm.

Furthermore, it goes without saying that the type of results shown in FIG. 7 are also realized in other embodiments of the reed relay of the present invention disclosed in the present Specification.

Figure 8:
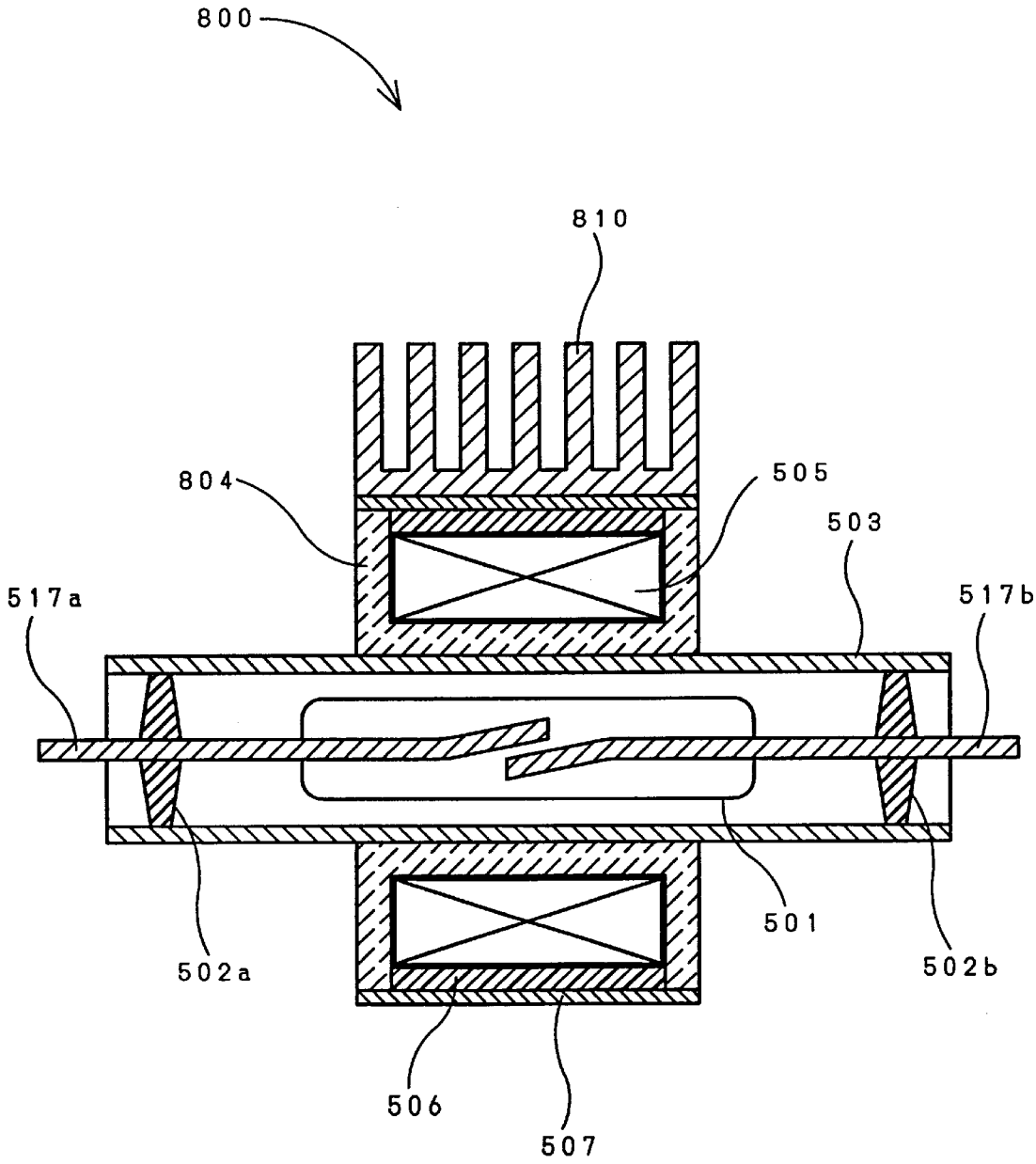
FIG. 8 is a cross section of the second embodiment of the present invention.

FIG. 8 shows the structural cross section of a second embodiment of the present invention. The main difference from the first embodiment in the figure is that there is coil bobbin 804 without an overhang, but a structure (also called a heat sink) 810 with a group of protrusions for increasing the heat radiation surface area and promoting natural cooling is attached to the surface of magnetic shield case 507. This type of structure 810 is formed by cutting out many rod-shaped protrusions from an aluminum, etc., piece. By means of this structure, heat radiation capability can be increased by increasing the enveloped surface area.

By using this structure, it is possible to promote thermal conduction from the surface of magnetic shield case 507 to the atmosphere and reduce the amount of thermal conduction from coil 505 to electrostatic shielded pipe 503, and as a result, to control offset current.

Figure 9A:
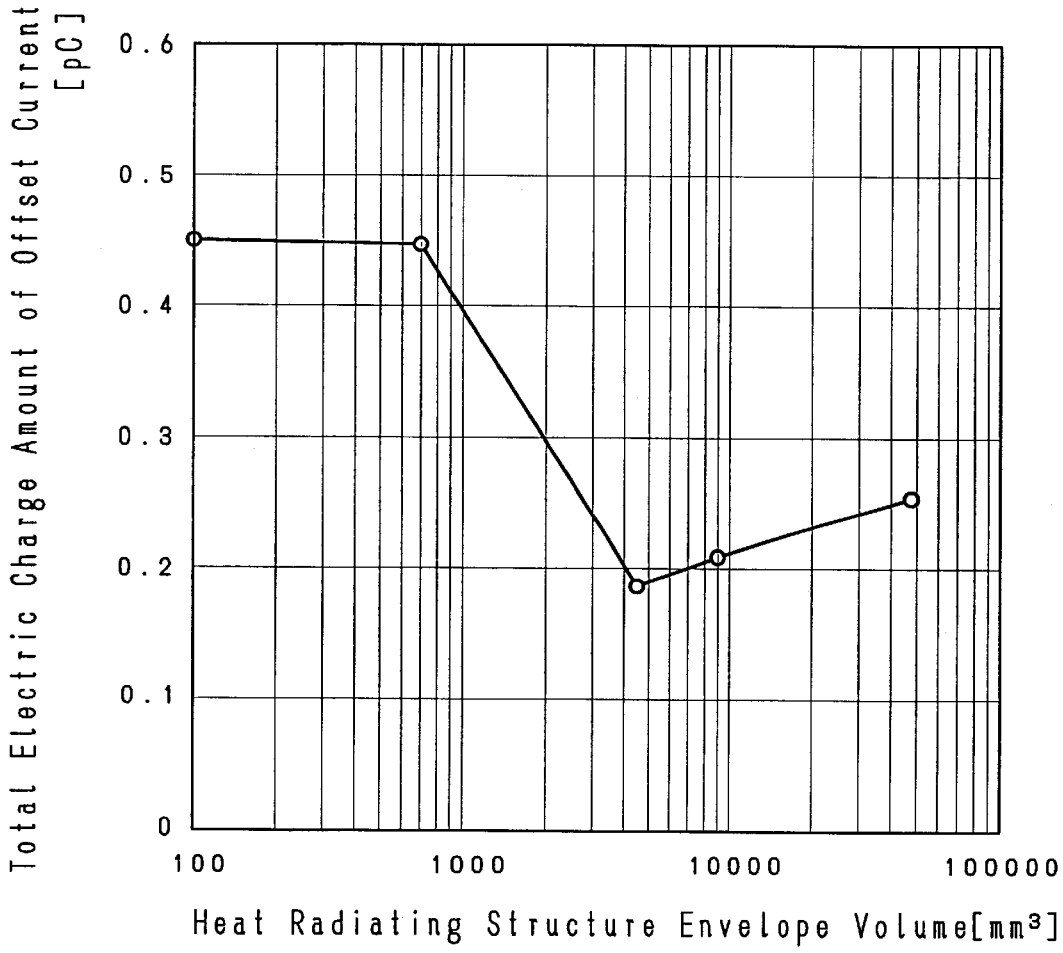
FIG. 9A is a graph showing the effect of inhibiting an increase in temperature in the structure of the second embodiment.
Figure 9B:
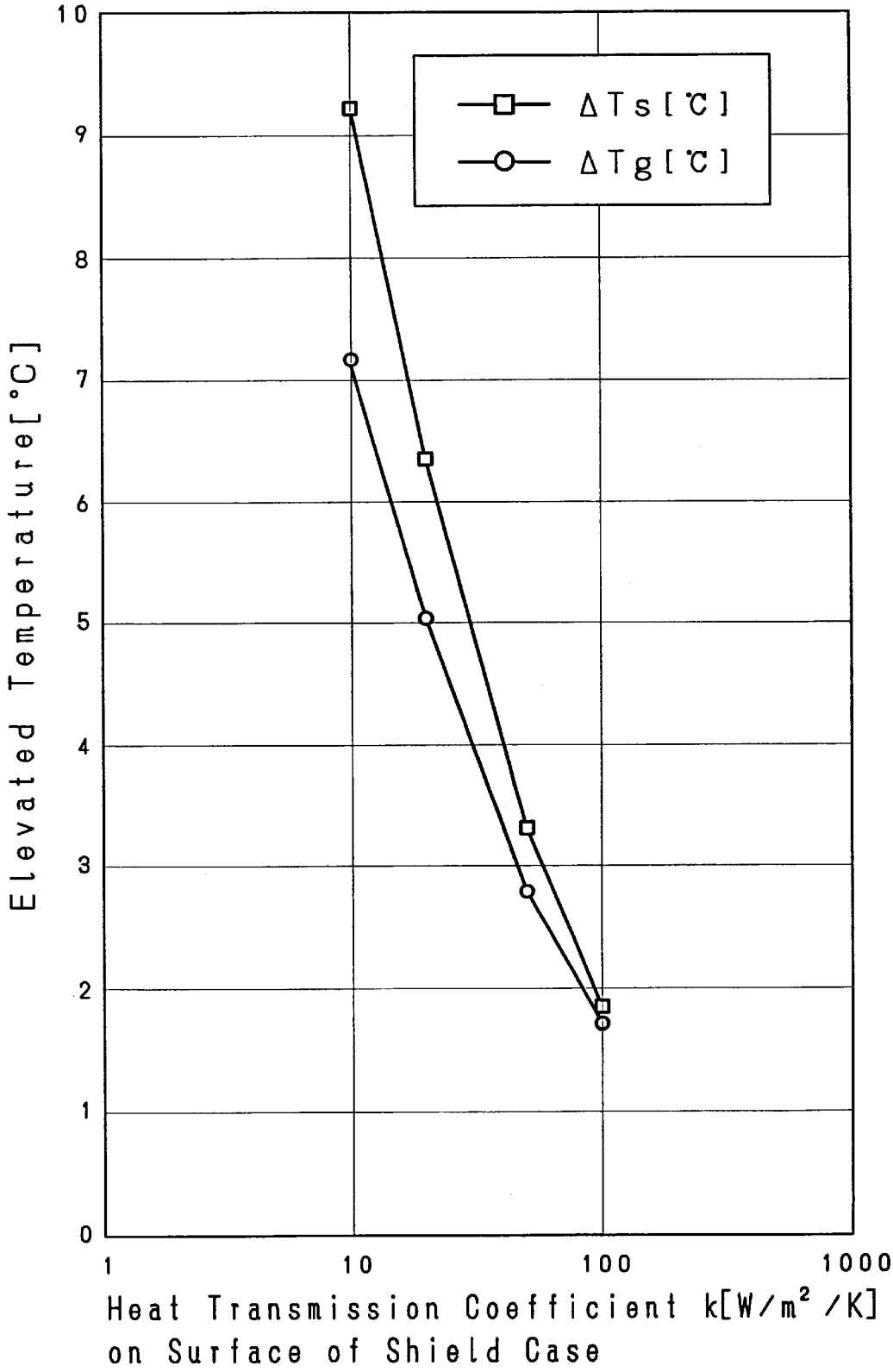
FIG. 9B is a graph showing the effect of inhibiting an increase in temperature in the structure of the second embodiment.

The findings of quantitatively confirming this effect by experiment will be explained. The x-axis in FIG. 9A is the enveloped volume of the heat-radiating structure (heat-radiating substance) and the y-axis is the total charge of the offset current flowing into the signal conductors. It is clear that once the enveloped volume exceeds 4,000 $mm^3$ the total charge flowing into the signal conductors is reduced and heat-radiating activity is realized. Results that are an estimate in this case of the relationship between the heat transfer coefficient from the heat-radiating structure to the atmosphere and ΔTg based on thermal conduction simulations as in the above-mentioned first embodiment are shown in FIG. 9B.

It is clear that when the heat transfer coefficient of magnetic shield case 507 increases equivalent to an increase in enveloped volume, an increase in the temperature of electrostatic shielded pipe 503 is prevented.

That is, offset current is inhibited by using the heat-radiating structure.

An alternative to the second embodiment is to attach a heat pipe to the surface of magnetic shield case 507, so that the heat pipe extends to a place of good space efficiency and to attach a heat sink at this place.

Figure 10:
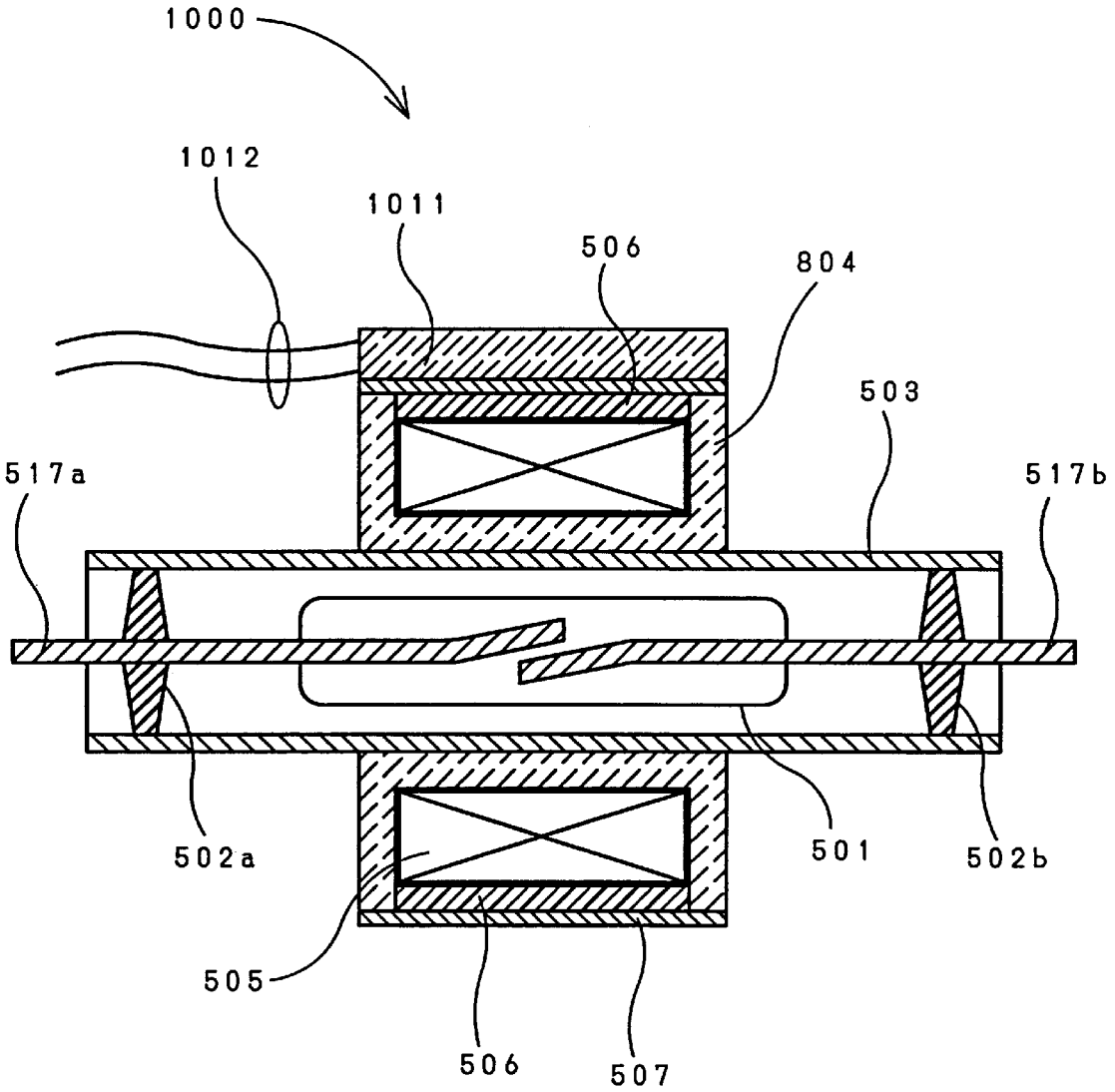
FIG. 10 is a cross section showing the third embodiment of the present invention.

FIG. 10 shows the structural cross section of a third embodiment of the present invention. The major point of difference from the second embodiment in the figure is that thermoelectric effect element 1011 (that is, a Peltier device) with heat-absorbing activity is attached directly above coil bobbin 804 (that is, to the surface of magnetic shield case 507) in place of heat sink 810.

Figure 4A:
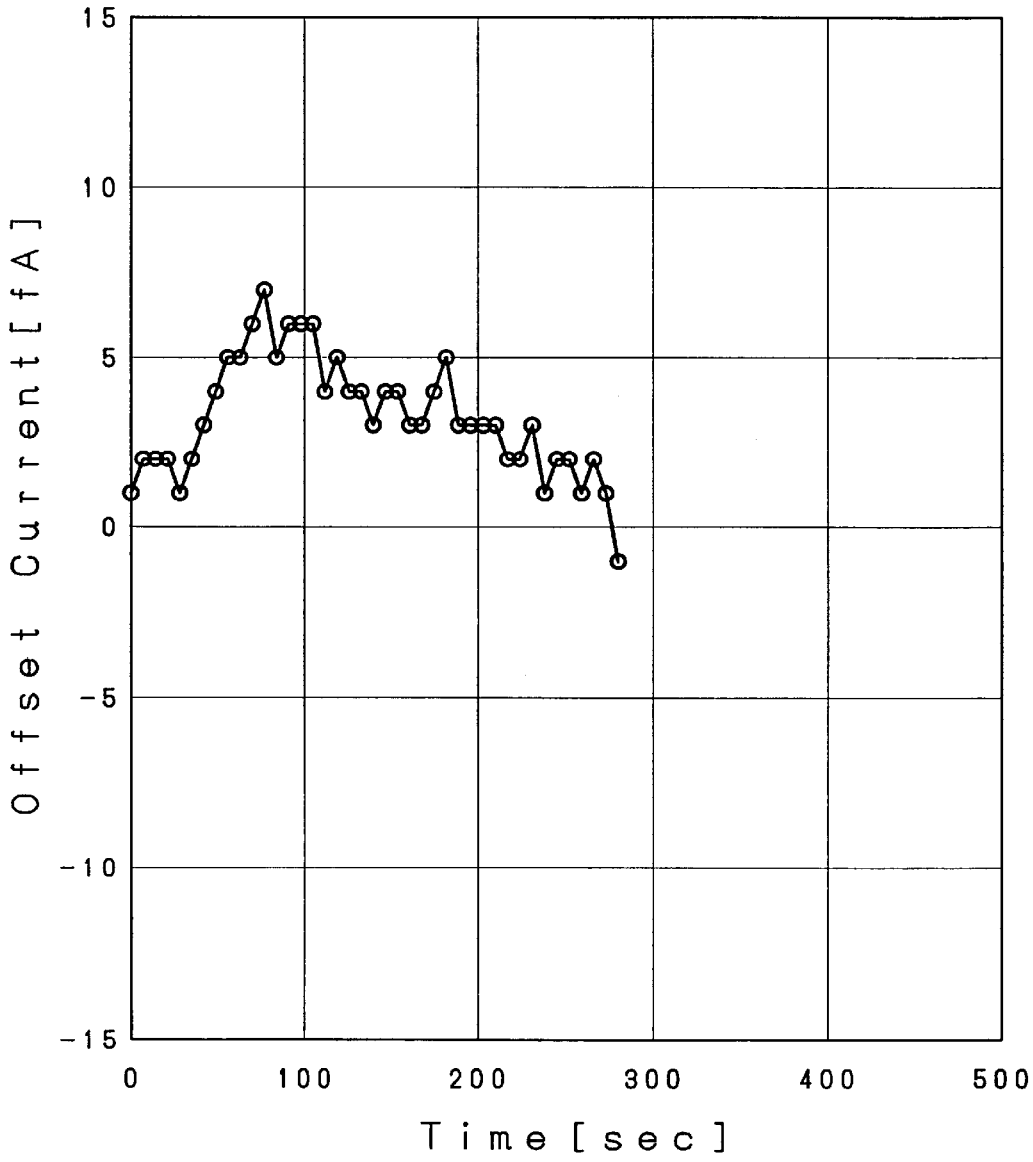
FIG. 4A is a graph showing the results of experiments to clarify the factors of offset currents from the reed relay in FIG. 3.
Figure 4B:
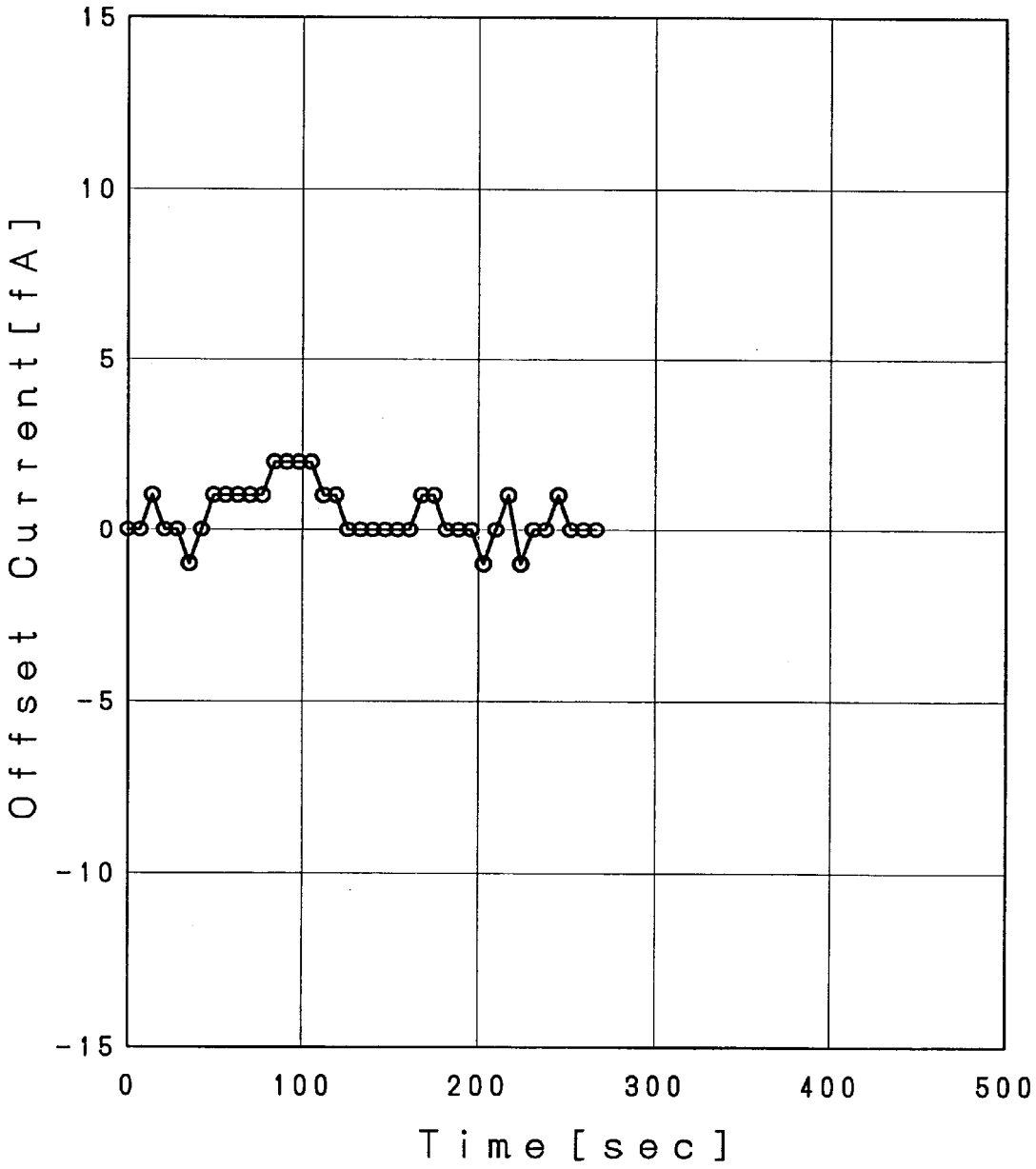
FIG. 4B is a graph showing the results of experiments to clarify the factors of offset currents from the reed relay in FIG. 3.

A Peltier device is a plate-shaped element with which heat is transported by force from the bottom to the top in FIG. 10 by DC electricity that is applied by wire 1012 for feeding power to the device. The amount of heat that is transported can be controlled by controlling the electric energy that is applied. The effect of reducing offset current is the same as in FIG. 4B when heat is absorbed from the surface of magnetic shield case 507 using this thermoelectric effect element.

Figure 11:
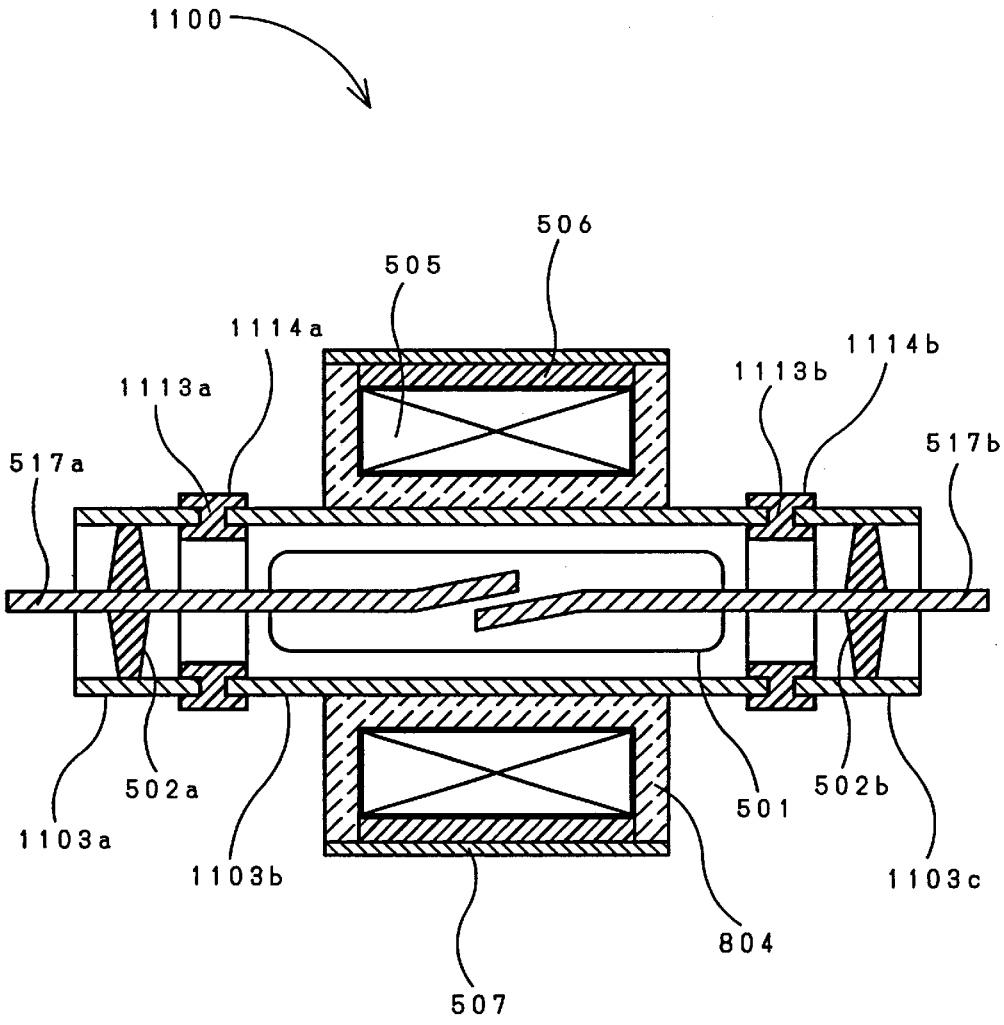
FIG. 11 is a cross section showing the fourth embodiment of the present invention.

FIG. 11 shows a structural cross section of a fourth embodiment of the present invention. The main point of difference from the first embodiment in the figure is that, as in the second embodiment, the coil bobbin has no overhangs, but the electrostatic shielded pipe is divided into three parts, the bushing part at both ends (1103*a* and 1103*c*) and the coil bobbin part (1103*b*), and two spacers 1113*a* and 1113*b* with low thermal conductivity are inserted somewhere along these pipes. Spacers 1113*a* and 1113*b* are ring-shaped with an "H"-shaped cross section. The divided electrostatic shielded pipes 1103*a* through 1103*c* are sandwiched in the concave parts on both sides of this "H". Electrical connection between each of the divided electrostatic shielded pipes 1103*a* through 1103*c* is accomplished by forming conductive metal films 1114*a* and 1114*b* on the surface of spacers 1113*a* and 1113*b*, only as needed, and bringing this film into contact with each electrostatic shielded pipe to the left and the right.

By sandwiching spacers 1113*a* and 1113*b* with very poor thermal conductivity somewhere along electrostatic shielded pipes 1103*a* through 1103*c* with very high thermal conductivity, it is possible to prevent thermal conduction from coil bobbin part 1103*b* of the electrostatic shielded pipes to bushing parts 1103*a* and 1103*c*, and thereby prevent an increase in temperature of bushings 502*a* and 502*b* at both ends.

Figure 12:
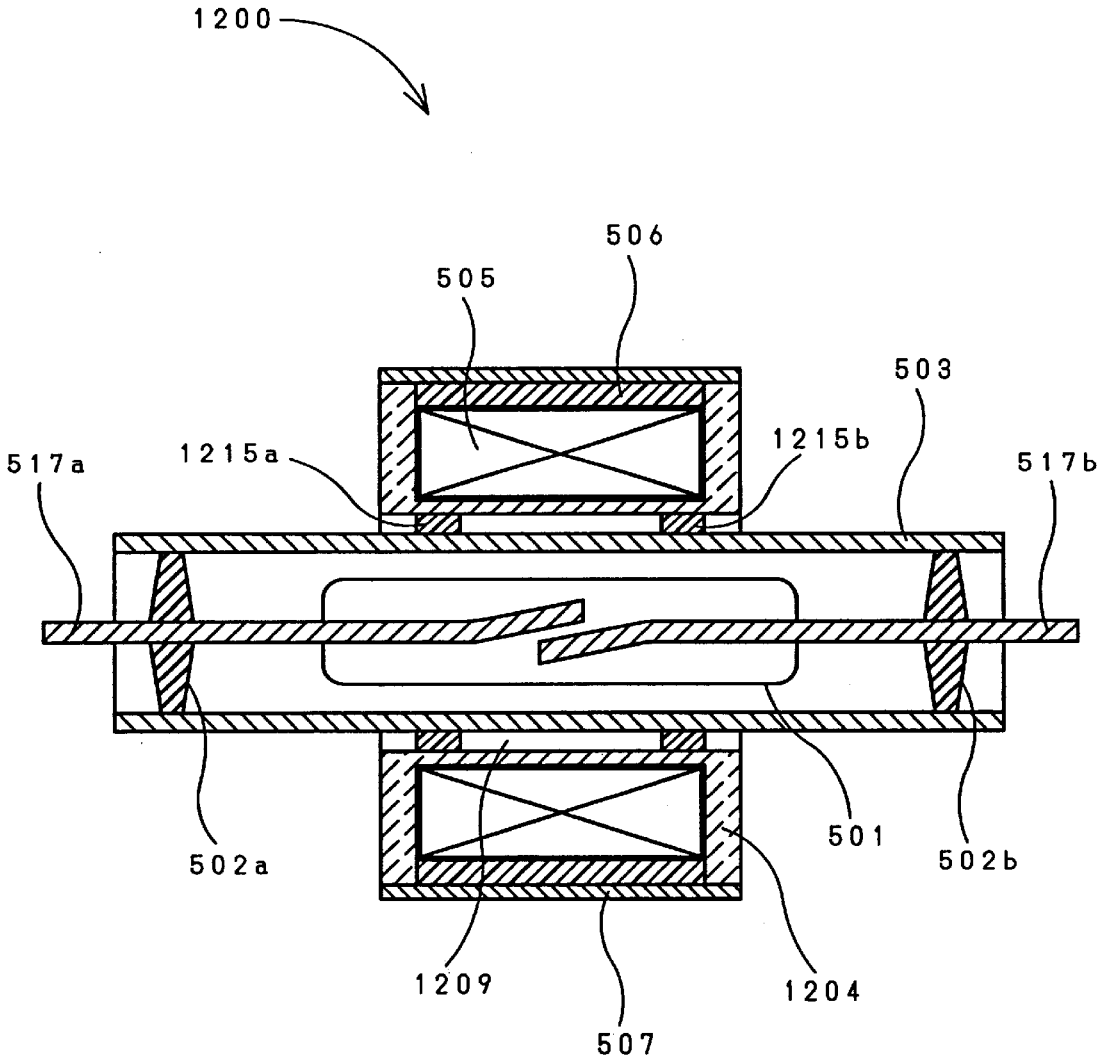
FIG. 12 is a cross section showing the fifth embodiment of the present invention.

FIG. 12 is a structural cross section of a fifth embodiment of the present invention. There are none of the overhangs of the first embodiment in this structure. Coil bobbin 1204 whose hollow part is larger than electrostatic shielded pipe 503 is used. Ring-shaped spacers 1215*a* and 1215*b* with low thermal conductivity are placed on the outside of electrostatic shielded pipe 503 and these are inserted in the hollow part of coil bobbin 1204. That is, coil bobbin 1204 and electrostatic shielded pipe 503 come into contact only at these spacers 1215*a* and 1215*b* and there is space 1209 between the inside face of the hollow part of coil bobbin 1204 and electrostatic shielded pipe 503.

Insofar as using a material with a very low thermal conductivity, such as PTFE, etc., for ring-shaped spacers 1215*a* and 1215*b* is concerned, the net thermal-contact surface area from coil bobbin 1204 to electrostatic shielded pipe 503 can be reduced competently and therefore, thermal conduction from coil bobbin 1204 to electrostatic shielded pipe 1203 is markedly restricted.

Figure 13:
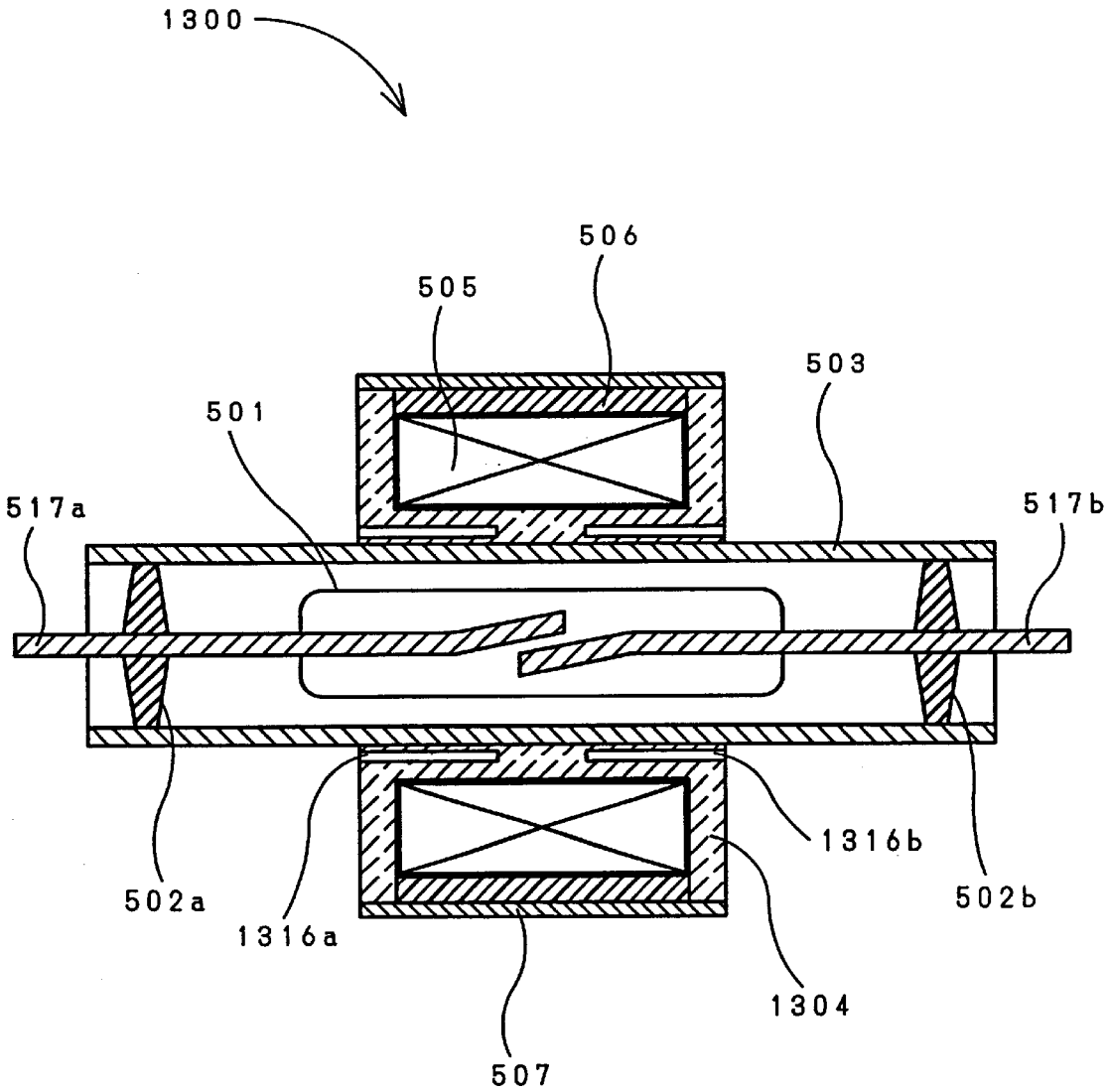
FIG. 13 is a cross section showing the sixth embodiment of the present invention.

FIG. 13 shows the structural cross section of a sixth embodiment of the present invention. Cylindrical notches (1316*a* and 1316*b*) of the same axis as the hollow part of coil bobbin 1304 are made from both end faces of coil bobbin 1304 on the back of the inside face of the hollow part so that the body of coil bobbin 1304 becomes narrow. As a result, the net cross-sectional area (or effective cross-sectional area) of the thermal conduction path from the coil to the electrostatic shielded pipe surface is reduced, and thermal conduction from the coil toward the electrostatic shielded pipe is restricted.

A coil bobbin 304 with the structure in FIG. 13 can be made at low cost with a mold using polyacetal with good workability.

Figure 14:
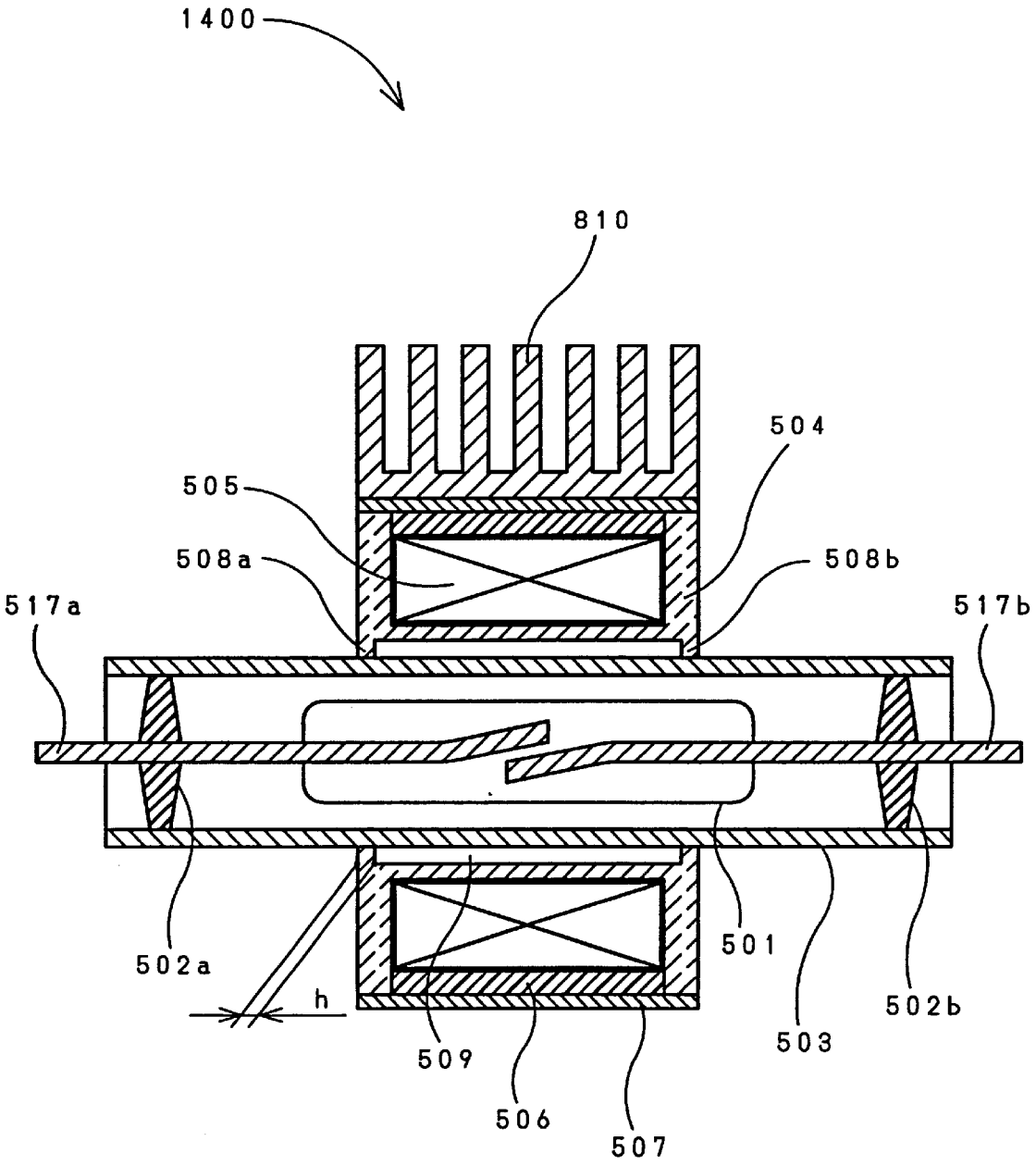
FIG. 14 is a cross section showing the seventh embodiment of the present invention.

FIG. 14 shows a structural cross section of a structure that is a combination of the first embodiment and the second embodiment as a seventh embodiment of the present invention. That is, heat sink 810 of the second embodiment is attached to the surface of magnetic shield case 507 in the structure of the first embodiment. Having both the structures of the first embodiment and the second embodiment has the effect of preventing even further thermal conduction from the coil to electrostatic shielded pipe 503 when large amounts of heat are generated by coil 505.

Figure 15:
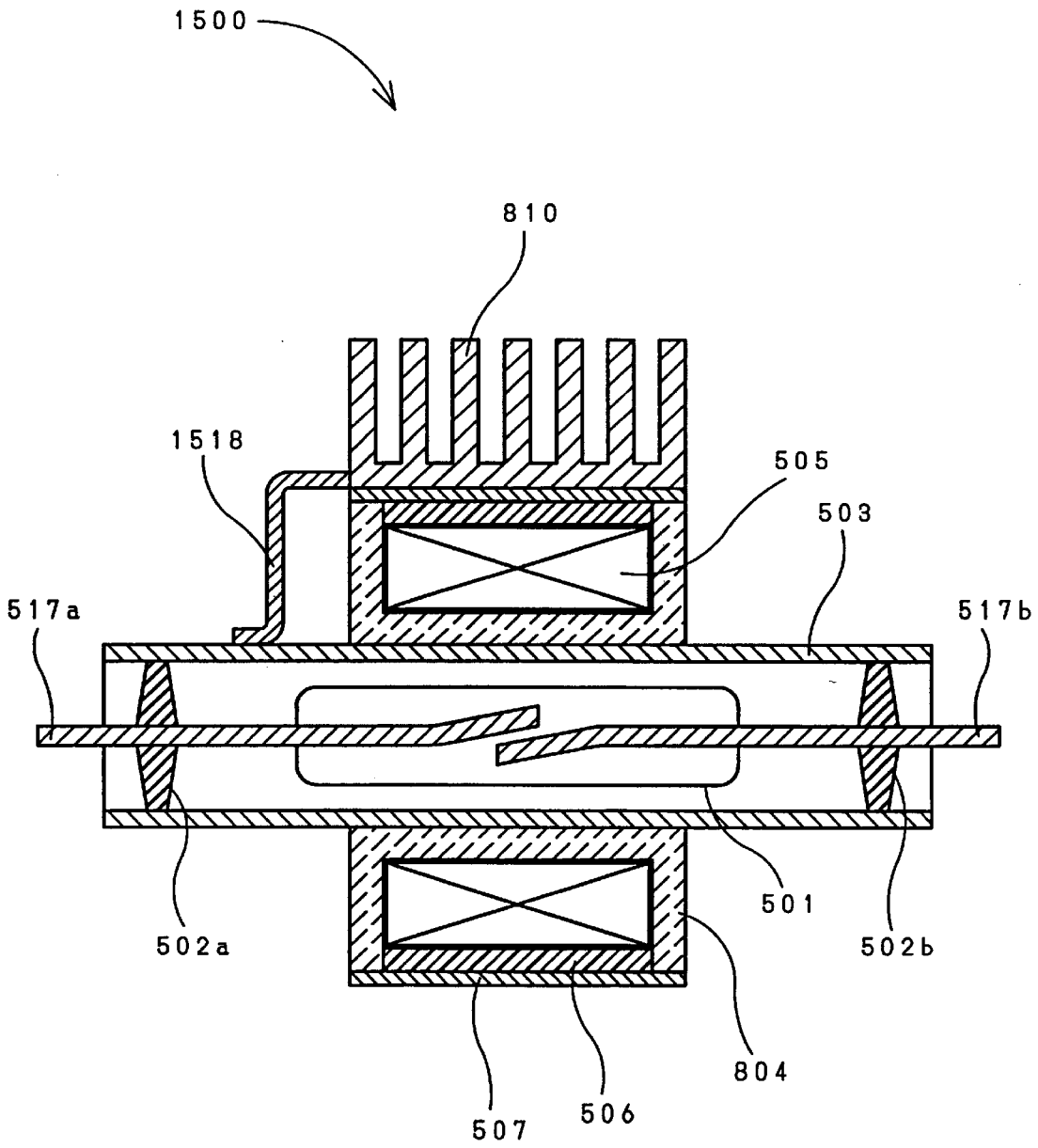
FIG. 15 is a cross section showing the eighth embodiment of the present invention.

FIG. 15 shows a structural cross section of an eighth embodiment of the present invention. In addition to the structure of the second embodiment, heat pipe 1518 is used as a structure made from a metal such as aluminum, etc., having a structure wherein one end is brought into contact with the surface of electrostatic shielded pipe 503, while the other end touches heat sink 810. As a result, the heat generated by the coil that has passed from coil 505 through coil bobbin 504 to escape to electrostatic shielded pipe 503 is transmitted to heat sink 810 by this heat pipe 1518, having the effect of preventing an increase in the surface temperature of bushings 502*a* and 502*b*. Consequently, the generation of the above-mentioned offset current can be prevented even further. Incidentally, multiple heat pipes 1518 can be used, and they can be placed at both ends of electrostatic shielded pipe 503. Moreover, another heat-absorbing element, such as a Peltier device, etc., can be attached in place of heat sink 810.

Figure 16:
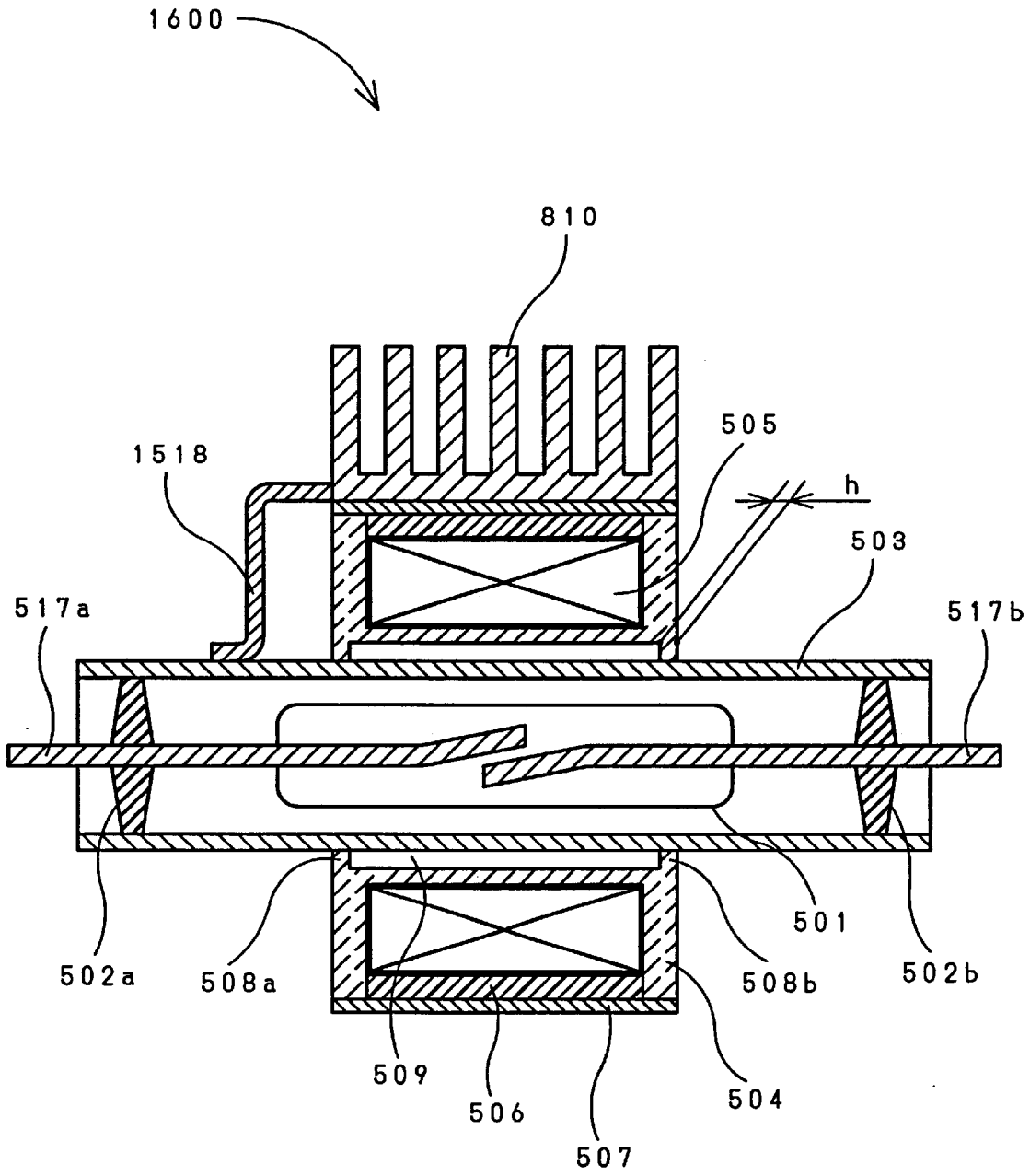
FIG. 16 is a cross section showing the ninth embodiment of the present invention.

FIG. 16 shows a structural cross section of a structure that is a combination of the eight embodiment with the first embodiment as a ninth embodiment of the present invention. That is, coil bobbin 504 of the first embodiment serves as the coil bobbin of the eighth embodiment. Heat transmission from coil 505 to electrostatic shielded pipe 503 can be prevented even further by overhangs 508*a* and 508*b* of the same coil bobbin and generation of offset current can therefore be prevented. In addition, multiple heat pipes 1518 can be used, and these can be placed toward both ends of the electrostatic shielded pipe. Moreover, another heat-absorbing element, such as a Peltier element, etc., can be attached in place of heat sink 810.

Figure 21:
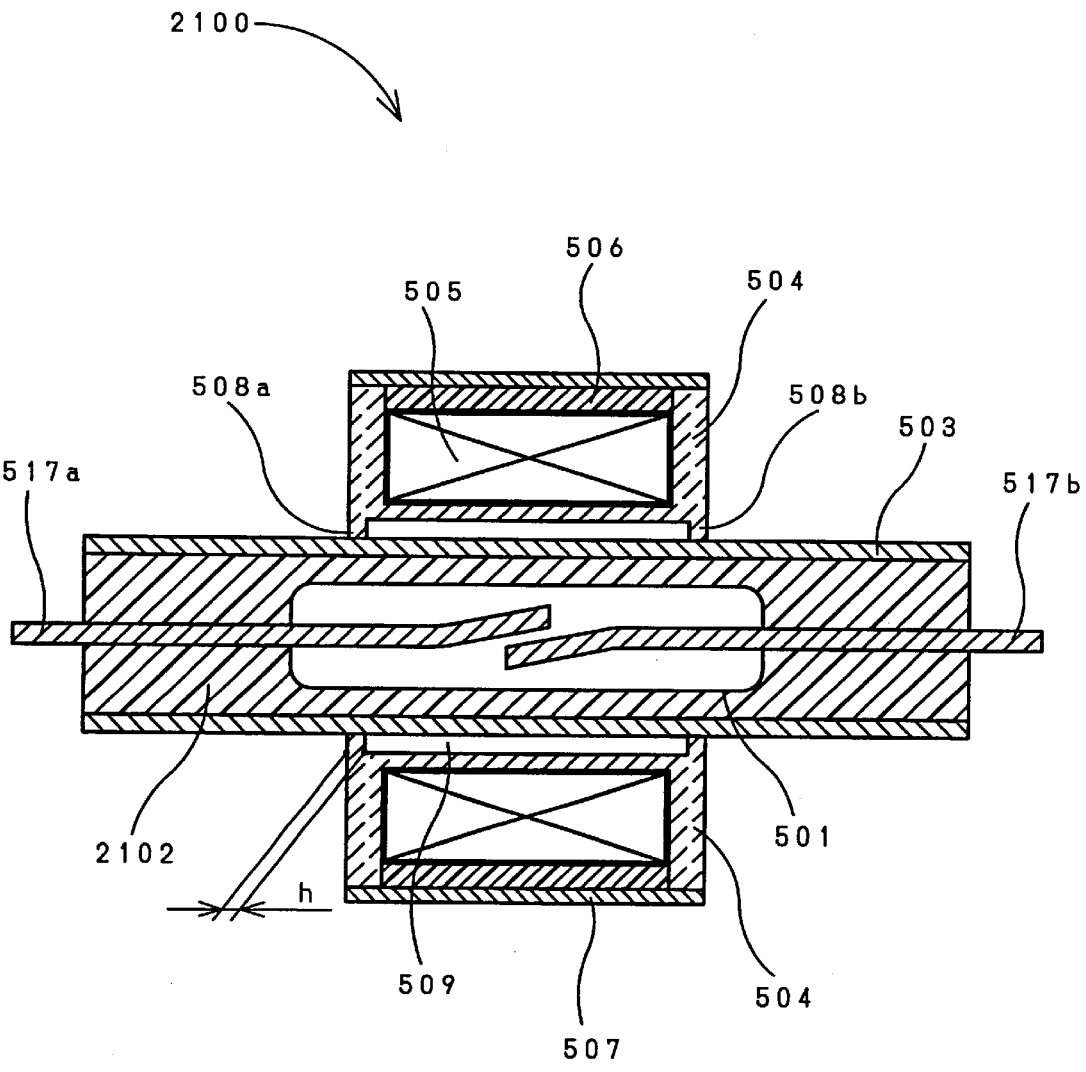
FIG. 21 is a cross section of the tenth embodiment of the present invention.

FIG. 21 shows a structural cross section of a tenth embodiment of the present invention. That is, the structure is one wherein a high-insulating resin (2102) such as epoxy, etc., is packed between electrostatic shielded pipe 503 and reed switch 501 in place of bushings 502*a* and 502*b* in the first embodiment and thereby supports reed switch 501. The heat transmitted from coil 505 to electrostatic shielded pipe 503 is reduced by overhangs 508*a* and 508*b* and therefore, generation of thermally stimulated current can be prevented. Nevertheless, the signal conductor terminals of reed switch 501 touch resin 2102 with a lower insulation resistance than air and therefore, there is an increase in leakage current. Consequently, insulation performance is inferior, but production at a low cost is possible. Moreover, the structure wherein resin is packed in part of electrostatic shielded pipe 503 in place of 2102 to support reed switch 501, or the structure wherein a thick plate-shaped bushing is placed at least one place anywhere in the electrostatic shielded pipe to support reed switch 501, can be used as alternative embodiments.

A reed relay has been described in the present Specification as an example, but the present invention can be applied to other relays and contact switching devices. Moreover, wet relays called "mercury relays," as well as dry relays called "reed relays," are included among the relays of the present invention.

Moreover, the relay of the present invention is not limited to the above-mentioned embodiments and a variety of methods can be used to support the signal conductors of the reed switch by insulating members in place of plate-shaped bushings. Moreover, various shapes with a cylindrical conductor are used for the electrostatic shielded pipe.

Furthermore, the above-mentioned reed relay of the present invention can be used as a multi-pass relay or multi-contact relay wherein multiple reed switches are placed in parallel rows inside the hollow part of the coil bobbin, or as a multi-pass break relay. The present invention can also be used in make/break mixed relays and transfer relays, etc.

As previously mentioned, when the present invention is used, it is possible to present a reed relay with which offset current due to thermally stimulated current can be prevented competently, even when a coil is excited for relay operation, and high-speed, high-accuracy measurement of very low signals is possible.

Moreover, it is not always necessary to excite the coil by the present invention and therefore, a low power-consuming reed relay for measurement of very low signals can be presented.

Furthermore, by means of the present invention, the electrostatic shield pipe is supported and fixed with stability in the cylindrical hollow part of a coil bobbin in any embodiment, and therefore, a reed relay for measuring very low signals with which production cost during assembly is inexpensive can be presented.

The material of the reed switch terminal part is usually a magnetic metal (Fe—Ni alloy) and therefore, when a relay terminal is connected by wiring to an outside terminal, a potential difference is produced due to contact between different metals where this magnetic metal and solder (Pb—Sn alloy) and copper wires come into contact (contact-electromotive force). When the temperature of these metals that contact one another changes, this potential difference fluctuates due to a difference in the temperature coefficient of electromotive force. This becomes a factor that disturbs of voltage signal measurements (thermo-electromotive force). The above-mentioned embodiments according to the present invention all have the effect of preventing thermal conduction to the reed switch and therefore, also prevent changes in the temperature of the relay terminal part. That is, effects by electromotive force can also be prevented, and this has a positive effect in terms of high-speed, high-accuracy voltage measurements.

What is claimed is:

1. A reed relay for very low currents, comprising:

a coil bobbin;

an electrostatic shielded pipe inserted into said coil bobbin;

insulating support members placed inside said electrostatic shielded pipe; and a reed switch held inside said electrostatic shielded pipe by said support members, wherein a thermal conduction-blocking means is placed between the coil that has been wound and installed around said coil bobbin and said reed switch so as to control thermally stimulated current that flows to the above-mentioned reed switch;

and further wherein said thermal conduction-blocking means comprises a member that is narrower than the body of the coil bobbin in order to reduce the net cross-sectional area of the thermal conduction path.

2. A reed relay according to claim 1, wherein said insulating support members are plate-shaped bushings that are arranged near both ends of said electrostatic shielded pipe.

3. A reed relay according to claim 1, wherein said insulating support members are insulating resin packed in said electrostatic shielded pipe.

4. A reed relay according to claim 1, wherein said blocking means comprises 1 or multiple ring-shaped members that support said electrostatic shielded pipe.

5. A reed relay according to claim 4, wherein said 1 or multiple ring-shaped members are insulating spacers installed around the outside of said electrostatic shielded pipe.

6. A reed relay according to claim 4, wherein said 1 or multiple ring-shaped members are formed as one unit with said coil bobbin on the inside face of the hollow part of said coil bobbin.

7. A reed relay according to claim 6, wherein the contact surface between the ring-shaped members formed as one unit with said coil bobbin and said electrostatic shielded pipe spreads out like an open fan.

8. A reed relay, comprising:

a reed switch;

an electrostatic shielded pipe through which the above-mentioned reed switch passes;

insulating support members supporting the above-mentioned reed switch inside said electrostatic shielded pipe;

a coil bobbin with a hollow part in which said electrostatic shielded pipe is placed; and a coil that is wound and installed around said coil bobbin, wherein there is a thermal conduction-blocking means between said coil bobbin and said electrostatic shielded pipe, making it difficult for heat from said coil to be transmitted, with said blocking means also serving as a mechanical support for said coil bobbin and said electrostatic shielded pipe, and further wherein said blocking means comprises a member that is narrower than the body of the coil bobbin in order to reduce the net cross-sectional area of the thermal conduction path.

9. A reed relay according to claim 8, wherein said blocking means has multiple columnar members that support said electrostatic shielded pipe and said columnar members are scattered on the inside face of the hollow part of said coil bobbin.

10. A reed relay according to claim 9, wherein said columnar members are nodular members with tapered tips.

11. A reed relay according to claim 8, wherein there is a coil-bobbin heat-absorbing means attached to said coil bobbin in order to reduce the heat from said coil before said heat is transmitted to said electrostatic shielded pipe.

12. A reed relay according to claim 11, wherein there is a shielded-pipe heat-absorbing means attached to said electrostatic shielded pipe in order to reduce the heat that has been transmitted to said electrostatic shielded pipe before it is transmitted to said reed switch.

13. A reed relay according to claim 12 wherein said shielded-pipe heat-absorbing means is a heat pipe that connects said electrostatic shielded pipe and said coil-bobbin heat-absorbing means, with the heat of said electrostatic shielded pipe being drawn from said heat pipe to said coil-bobbin heat-absorbing means.

14. A reed relay, comprising:

a coil bobbin with a hollow part;

a first electrostatic shielded pipe placed inside said hollow part;

ring-shaped electroconductive thermal conduction-blocking means attached to both ends of said first electrostatic shielded pipe;

a second and a third electrostatic shielded pipe further attached to the outside of each of said electroconductive thermal conduction-blocking means;

a reed switch that passes through said first through third electrostatic shielded pipes;

insulating support members placed inside said second and third electrostatic shielded pipes that support said reed switch; and a coil that is wound and installed around said coil bobbin.

15. A reed relay according to claim 14, wherein said electroconductive thermal conduction-blocking means is a ring molded from an insulating member, the surface of which is coated with an electroconductive film.

16. A reed relay, comprising:

a reed switch;

an electrostatic shielded pipe through which said reed switch passes;

insulating support members supporting said reed switch inside said electrostatic shielded pipe;

a coil bobbin with a hollow part in which said electrostatic shielded pipe is placed;

a coil that is wound and installed around said coil bobbin; and a coil-bobbin heat-absorbing means attached to said coil bobbin in order to reduce the heat from said coil before said heat is conducted to said electrostatic shielded pipe.

17. A reed relay according to claim 16, wherein said coil-bobbin heat-absorbing means is a heat sink.

18. A reed relay according to claim 16, wherein said coil-bobbin heat-absorbing means is a Peltier device.

* * * * *